US012796794B2

(12) United States Patent
Hiett

(10) Patent No.: US 12,796,794 B2
(45) Date of Patent: Nov. 17, 2026

(54) MULTIPLE CHANNEL DIFFUSER SYSTEM

(71) Applicant: Michelle Hiett, Willow Grove, PA (US)

(72) Inventor: Michelle Hiett, Willow Grove, PA (US)

( * ) Notice: Subject to any disclaimer, the term of this patent is extended or adjusted under 35 U.S.C. 154(b) by 294 days.

(21) Appl. No.: 18/812,358

(22) Filed: Aug. 22, 2024

(65) Prior Publication Data

US 2025/0064194 A1 Feb. 27, 2025

Related U.S. Application Data

(60) Provisional application No. 63/578,389, filed on Aug. 24, 2023.

(51) Int. Cl.
*A45D 20/26* (2006.01)
*A45D 20/30* (2006.01)

(52) U.S. Cl.
CPC ..... *A45D 20/26* (2013.01); *A45D 20/30* (2013.01)

(58) Field of Classification Search
CPC ..... A45D 20/26; A45D 20/30
USPC ..... 34/99
See application file for complete search history.

(56) References Cited

U.S. PATENT DOCUMENTS 2,726,658 A 12/1955 Chessey
3,587,577 A 6/1971 Oleg et al.
H902 H 4/1991 Rousseau
5,715,533 A * 2/1998 Stein ..... A42C 5/04 2/209.13
6,050,099 A * 4/2000 Lopa ..... A61F 7/10 62/304
6,598,236 B1 7/2003 Gantt
10,299,525 B1 * 5/2019 Buckman ..... A42B 1/008
11,065,148 B2 7/2021 Unver et al.
2007/0137685 A1 * 6/2007 Jwo ..... H10N 10/13 136/203
2017/0368381 A1 * 12/2017 Awiszus ..... A42B 1/0188
2018/0325205 A1 * 11/2018 Gardner ..... A42B 3/286
2019/0289946 A1 * 9/2019 Perusse ..... A62B 18/003
(Continued)

OTHER PUBLICATIONS

Kool breeze solar hard hat; The Warming Store; https://www.thewarmingstore.com/kool-breeze-solar-hard-hat.html?utm_content=ps-nonbrand&msclkid=fb0e7456032b1be27495130e60a475a5; 6 pages [Retrieved from the internet Dec. 20, 2024].
(Continued)

*Primary Examiner* — Connor J Tremarche
(74) *Attorney, Agent, or Firm* — Tariq Najee-Ullah; GIBRALTAR CONSULTING LLC DBA PATENT INSIDER

(57) ABSTRACT

A multiple channel diffuser system is disclosed that is designed to conform to the scalp of a user. The system includes a multiple channel diffuser with a first chamber and first diffuser channels. Each first diffuser channel has a proximal portion with a channel inlet and a distal portion with one or more channel outlets. The system also includes a fan, a power source connected to the fan's motor, a switch connected to the power source, a hose with a first and second end, and a housing that retains the power source, fan, and switch. The housing has an inlet opening where the first end of the hose is connected, allowing air from the fan to be discharged into the first chamber of the multiple channel diffuser. The one or more first diffuser channels then distribute the air to at least a portion of the user's scalp.

18 Claims, 27 Drawing Sheets

(56) References Cited

U.S. PATENT DOCUMENTS

| | | | | |
|---|---|---|---|---|
| 2020/0229530 | A1* | 7/2020 | Feher | A42B 3/286 |
| 2023/0120339 | A1* | 4/2023 | Kim | F04D 25/08 415/213.1 |

OTHER PUBLICATIONS

Portable 8 in. neck fan; HomeDepot; https://www.homedepot.com/pep/PRIVATE-BRAND-UNBRANDED-Portable-8-in-Neck-fan-FA-12/323190139?irgwc=1&cm_mmc=afl-ir-2003851-1420157-EdgeBingFlow&clickid=W5BRgbRhMxyPRhPUFDXXR3DBUkCV5ZUvX1faxk0; 4 pages. [Retrieved from the internet Dec. 10, 2024].

* cited by examiner

MULTIPLE CHANNEL DIFFUSER SYSTEM

This is a Non-provisional application of U.S. Provisional Application 63/578,389 filed Aug. 24, 2023. The entire content of which is incorporated herein in its entirety.

FIELD OF INVENTION

Embodiments disclosed herein relate to a multiple channel diffuser system configured to conform to the scalp of a user.

BACKGROUND OF THE INVENTION

Various diffuser systems have been developed for delivering air or other substances to the scalp of a user. These diffuser systems typically consist of a chamber or a series of channels through which the air or substance is directed towards the scalp. However, existing diffuser systems often lack the ability to conform to the shape of the user's scalp, resulting in inefficient and uneven distribution of the air or substance.

One approach in the prior art involves the use of a single channel diffuser system. In this approach, a single channel is used to direct the air or substance towards the scalp. However, this approach has limitations in terms of coverage and effectiveness. The single channel may not be able to reach all areas of the scalp, leading to inconsistent results. This can result in gaps or areas of uneven distribution, reducing the overall effectiveness of the diffuser system. Additionally, the lack of multiple channels restricts the ability to control the direction and flow of the air or substance, further limiting the effectiveness of the diffuser system.

Another approach in the prior art involves the use of a cooling helmet and/or cap device having diffuser channels designed to distribute the air or substance more evenly across the scalp. However, existing cooling helmet and/or cap devices are configured to cover a substantial portion of a user's hair. As a result, the cooling helmet is not capable of being concealed during use, for example, during public events and/or usage. It would be more desirable for a user, such as an entertainer, a public figure, and or any individual to be able to wear a scalp cooling device in a concealed manner, substantially underneath a user's hair for a more aesthetically pleasing appearance.

In summary, previous approaches to diffuser systems have focused on either single channel designs or cooling helmet and/or cap devices that do not adequately conform to the shape of the user's scalp. However, none of these approaches have provided a comprehensive solution that combines the features described in this disclosure.

Accordingly, there remains a need for an improved concealed multiple channel diffuser system. This need and other needs are satisfied by the various aspects of the present disclosure.

SUMMARY OF THE INVENTION

In accordance with the principles of the present invention, a multiple channel diffuser system may include a first chamber. A multiple channel diffuser system may include one or more first diffuser channels disposed on the first chamber, wherein the one or more first diffuser channels each having a proximal portion located opposite a distal portion. The proximal portion of the one or more first diffuser channels each have a channel inlet located on the first chamber. The one or more first diffuser channels each have one or more channel outlets. A multiple channel diffuser system may include a fan. A multiple channel diffuser system may include a power source. The power source is electrically connected to a motor of the fan. A multiple channel diffuser system may include a switch electrically connected to the power source. A multiple channel diffuser system may include a hose having a first end and a second end. A multiple channel diffuser system may include a housing retaining the power source, the fan, and the switch. The housing has an inlet opening. The first end of the hose is connected to the inlet opening of the housing. The inlet opening of the housing is configured to receive air from the fan and discharge the air into the first chamber of the multiple channel diffuser. The one or more first diffuser channels are configured to discharge the air from the first chamber of the multiple channel diffuser to at least a portion of the scalp of the user, and which also includes improvements that overcome the limitations of prior art scalp cooling systems is now met by a new, useful, and non-obvious invention.

In some aspects, the techniques described herein relate to a multiple channel diffuser system configured to conform to a scalp of a user, with comb-like structures, while positioned at the root of a user's hair, so as to be substantially covered by a user's hair when being worn by a user. The multiple channel diffuser system includes a multiple channel diffuser, including a first chamber and one or more first diffuser channels disposed on the first chamber. The one or more first diffuser channels each have a proximal portion located opposite a distal portion. The proximal portion of the one or more first diffuser channels each having a channel inlet located on the first chamber. The one or more first diffuser channels each having one or more channel outlets. The system has a fan and a power source. The power source is electrically connected to a motor of the fan. A switch is electrically connected to the power source. A hose has a first end and a second end. A housing may retain the power source, the fan, and the switch. The housing may have an inlet opening. The first end of the hose is connected to the inlet opening of the housing. The inlet opening of the housing is configured to receive air from the fan and discharge the air into the first chamber of the multiple channel diffuser. The one or more first diffuser channels are configured to discharge the air from the first chamber of the multiple channel diffuser to at least a portion of the scalp of the user.

In some aspects, the techniques described herein relate to a multiple channel diffuser system, further including: an outer wall surface of the housing having a clip. The clip is configured to attach to any object including, but not limited to a waist, a belt, and/or at least a portion of an article of clothing.

In some aspects, the techniques described herein relate to a multiple channel diffuser system, wherein the one or more channel outlets traverse a length of each of the one or more first diffuser channels.

In some aspects, the techniques described herein relate to a multiple channel diffuser system having a second chamber in communication with the inlet opening of the housing. One or more second diffuser channels are disposed on the second chamber. The one or more second diffuser channels each have a proximal portion located opposite a distal portion. The proximal portion of the one or more second diffuser channels each have a channel inlet located on the second chamber. The one or more second diffuser channels each have one or more channel outlets.

In some aspects, the techniques described herein relate to a multiple channel diffuser system, further including: a three-way fitting connected to the hose. The second chamber of the multiple channel diffuser is in communication with at least a portion of the three-way fitting.

In some aspects, the techniques described herein relate to a multiple channel diffuser system, wherein the distal portion of the one or more second diffuser channels is removably connected to the distal portion of the one or more first diffuser channels.

In some aspects, the techniques described herein relate to a multiple channel diffuser system, wherein the distal portion of the one or more first diffuser channels has a first fastener. The distal portion of the one or more second diffuser channels has a second fastener. The first fastener of the one or more first diffuser channels is configured to connect to the second fastener of the one or more second diffuser channels.

In some aspects, the techniques described herein relate to a multiple channel diffuser system, further including: a support structure extending from an inner wall surface of the housing. The support structure is configured to retain the power source.

In some aspects, the techniques described herein relate to a multiple channel diffuser system, wherein the one or more first diffuser channels are made of a flexible material.

In some aspects, the techniques described herein relate to a multiple channel diffuser system, wherein the one or more first diffuser channels are configured to be disposed under at least a portion of a user's hair.

In some aspects, the techniques described herein relate to a multiple channel diffuser system, wherein the first chamber of the multiple channel diffuser has a first end and a second end. The first end of the multiple channel diffuser having a first inlet opening configured to connect to the hose.

In some aspects, the techniques described herein relate to a multiple channel diffuser system configured to conform to a scalp of a user, including: a multiple channel diffuser, a first chamber; and a plurality of flexible diffuser channels disposed on the first chamber. The plurality of flexible diffuser channels each have a channel inlet located proximal to the first chamber. The plurality of flexible diffuser channels each have a plurality of channel outlets traversing a length of the plurality of flexible diffuser channels. A fan is connected to a motor. A hose has a first end and a second end. A housing retains the fan. The housing has an inlet opening. The first end of the hose is connected to the inlet opening of the housing. The inlet opening of the housing is configured to receive air from the fan and discharge the air into the first chamber of the multiple channel diffuser. The plurality of flexible diffuser channels are configured to discharge the air from the first chamber of the multiple channel diffuser to the scalp of the user. A power source is electrically connected to the motor of the fan. A switch is electrically connected to the power source.

In some aspects, the techniques described herein relate to a multiple channel diffuser system, wherein the plurality of channel outlets of the plurality of flexible diffuser channels are configured to overlay at least a portion of the head of the user when the multiple channel diffuser is worn on the head of the user.

In some aspects, the techniques described herein relate to a multiple channel diffuser system, wherein the plurality of channel outlets of the plurality of flexible diffuser channels are configured to overlay at least a portion of the scalp of the user when at least a portion of the multiple channel diffuser is worn under a portion of hair of the user.

Additional aspects of the invention will be set forth in part in the description which follows, and in part can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim. It should also be noted that directions and/or references, for example, such as up, down, top, bottom, and so on, may be used to facilitate discussion of drawings and are not intended to restrict application of claimed subject matter. Therefore, the following detailed description is not to be taken to limit claimed subject matter and/or equivalents.

DETAILED DESCRIPTION OF THE INVENTION

The present invention can be understood more readily by reference to the following detailed description of the invention and the examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

Figure 1:
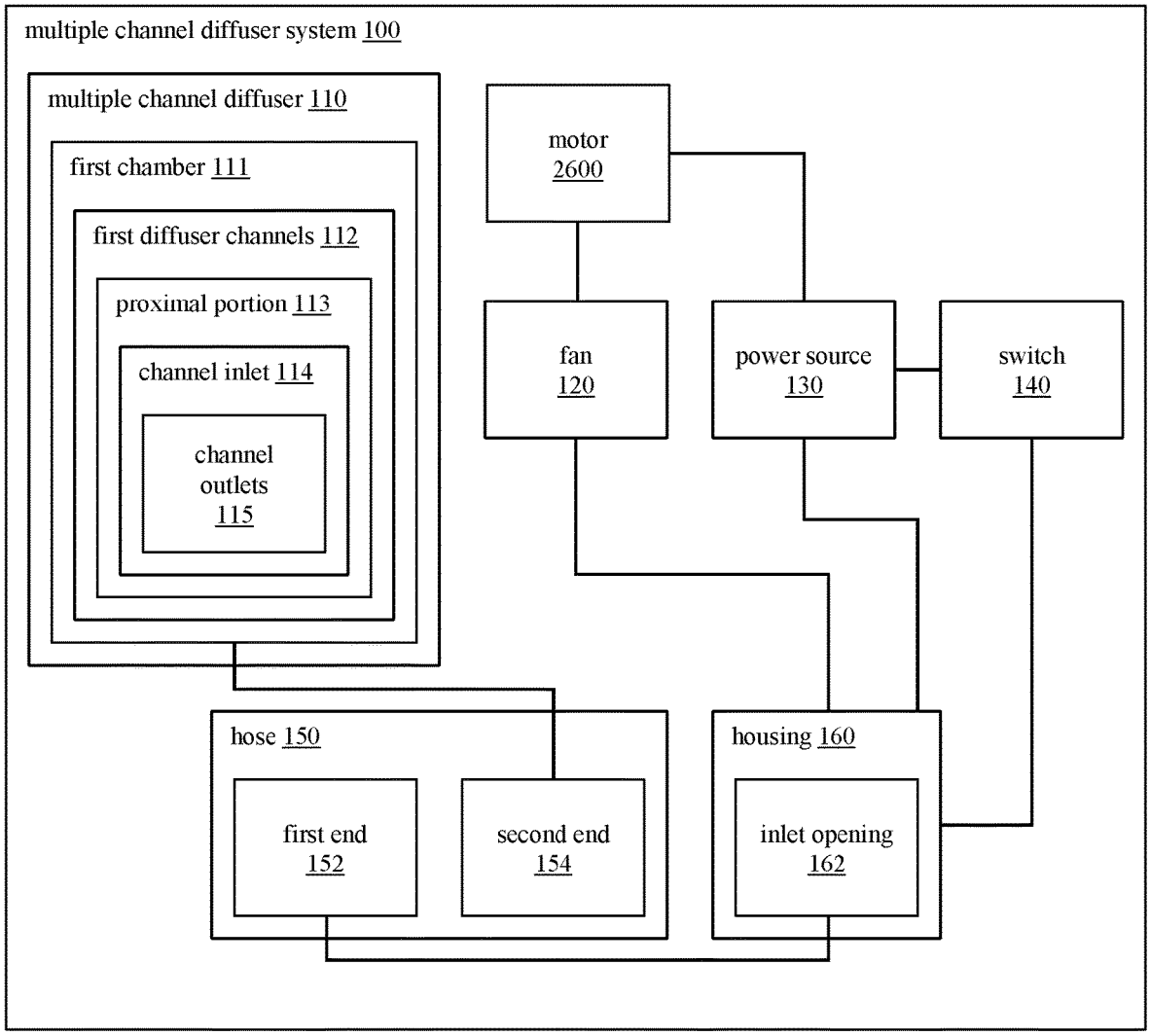
FIG. 1 is a block diagram illustrating a multiple channel diffuser system, according to some embodiments of the present disclosure.

FIG. 1 is a block diagram that describes a multiple channel diffuser system 100, according to some embodiments of the present disclosure. In some embodiments, the multiple channel diffuser system 100 may include a multiple channel diffuser 110, a fan 120, and a hose 150. The multiple channel diffuser system 100 may also include a power source 130. The power source 130 may be electrically connected to a motor of the fan 120. The multiple channel diffuser system 100 may also include a switch 140. The switch 140 may be electrically connected to the power source 130. The multiple channel diffuser system 100 may also include a housing 160. The housing 160 may retain the power source 130, the fan 120, and the switch 140. The switch 140 has a button, for example, that may be depressed by a user to power the battery "on" and "off".

In some embodiments, the multiple channel diffuser 110 may include a first chamber 111. The first chamber 111 may include one or more first diffuser channels 112 disposed on the first chamber 111. The one or more first diffuser channels 112 may include a proximal portion 113 located opposite a distal portion. The one or more first diffuser channels 112 each have a proximal portion located opposite a distal portion. The proximal portion 113 may include a channel inlet 114 located on the first chamber 111.

In some embodiments, the proximal portion 113 of the one or more first diffuser channels 112 each have a proximal portion located opposite a distal portion. The channel inlet 114 may include one or more channel outlets 115. The one or more first diffuser channels 112 each having a channel inlet 115 located on the first chamber 111. The hose 150 may include a first end 152 and a second end 154. The housing 160 may also include an inlet opening 162. The first end 152 of the hose 150 may be connected to the inlet opening of the housing 160. The inlet opening of the housing 160 may be configured to receive air from the fan 120 and discharge the air into the first chamber 111 of the multiple channel diffuser 110. The one or more first diffuser channels 112 may be configured to discharge the air from the first chamber 111 of the multiple channel diffuser 110 to at least a portion of the scalp of the user.

In some embodiments, the one or more channel outlets 115 may traverse a length of each of the one or more first diffuser channels 112. In some embodiments, the multiple channel diffuser system 100 may also include a support structure. The support structure may extend from an inner wall surface of the housing 160. The support structure is configured to retain the power source 130. In some embodiments, the one or more first diffuser channels 112 may be made of a flexible material. In some embodiments, the one or more first diffuser channels 112 may be configured to be disposed under at least a portion of a user's hair.

Figure 2:
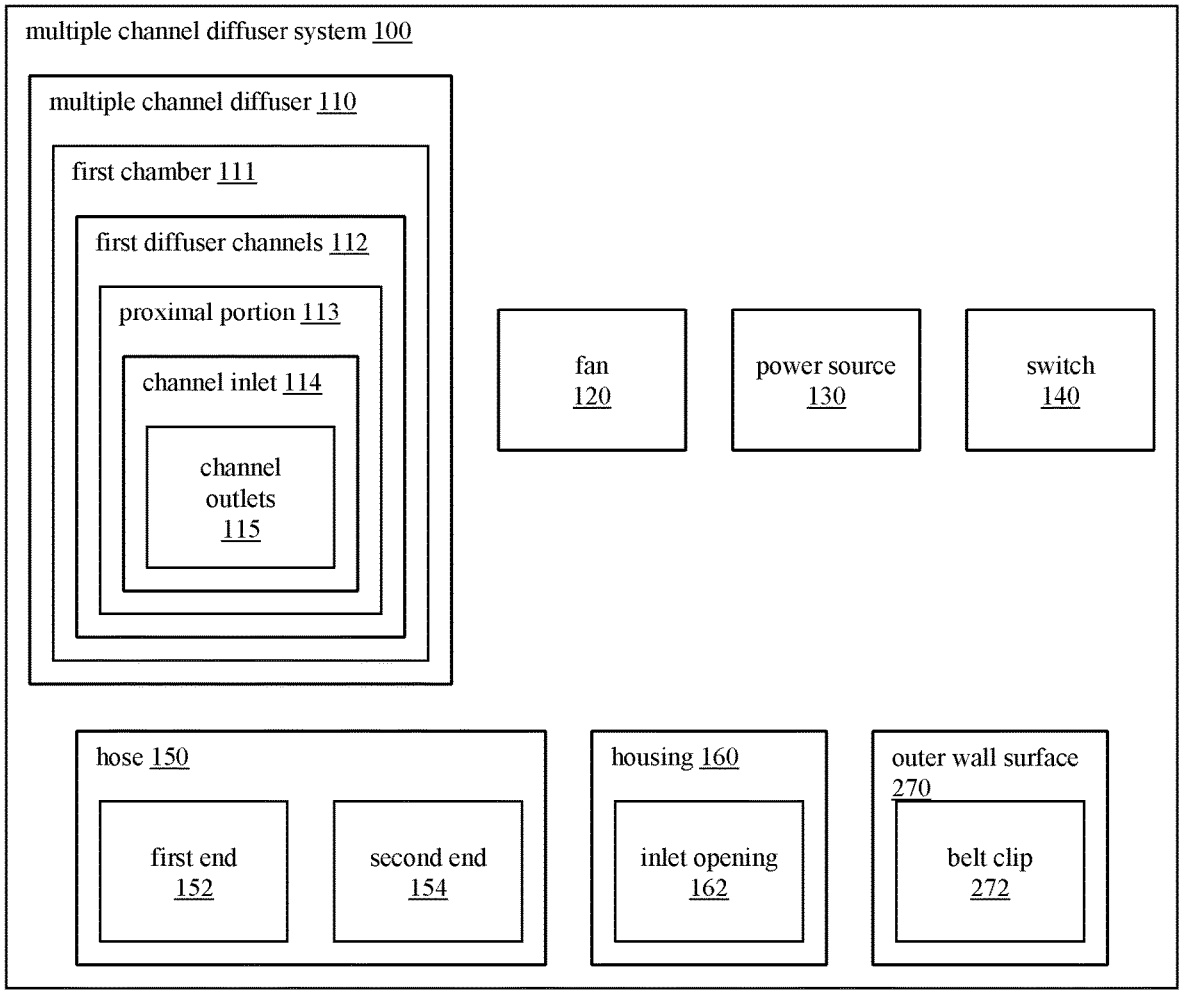
FIG. 2 is a block diagram further illustrating the multiple channel diffuser system from FIG. 1, according to some embodiments of the present disclosure.

FIG. 2 is a block diagram that further describes the multiple channel diffuser system 100 from FIG. 1, according to some embodiments of the present disclosure. In some embodiments, the multiple channel diffuser system 100 may include an outer wall surface 270 of the housing 160. The outer wall surface 270 may include a clip 272.

Figure 3:
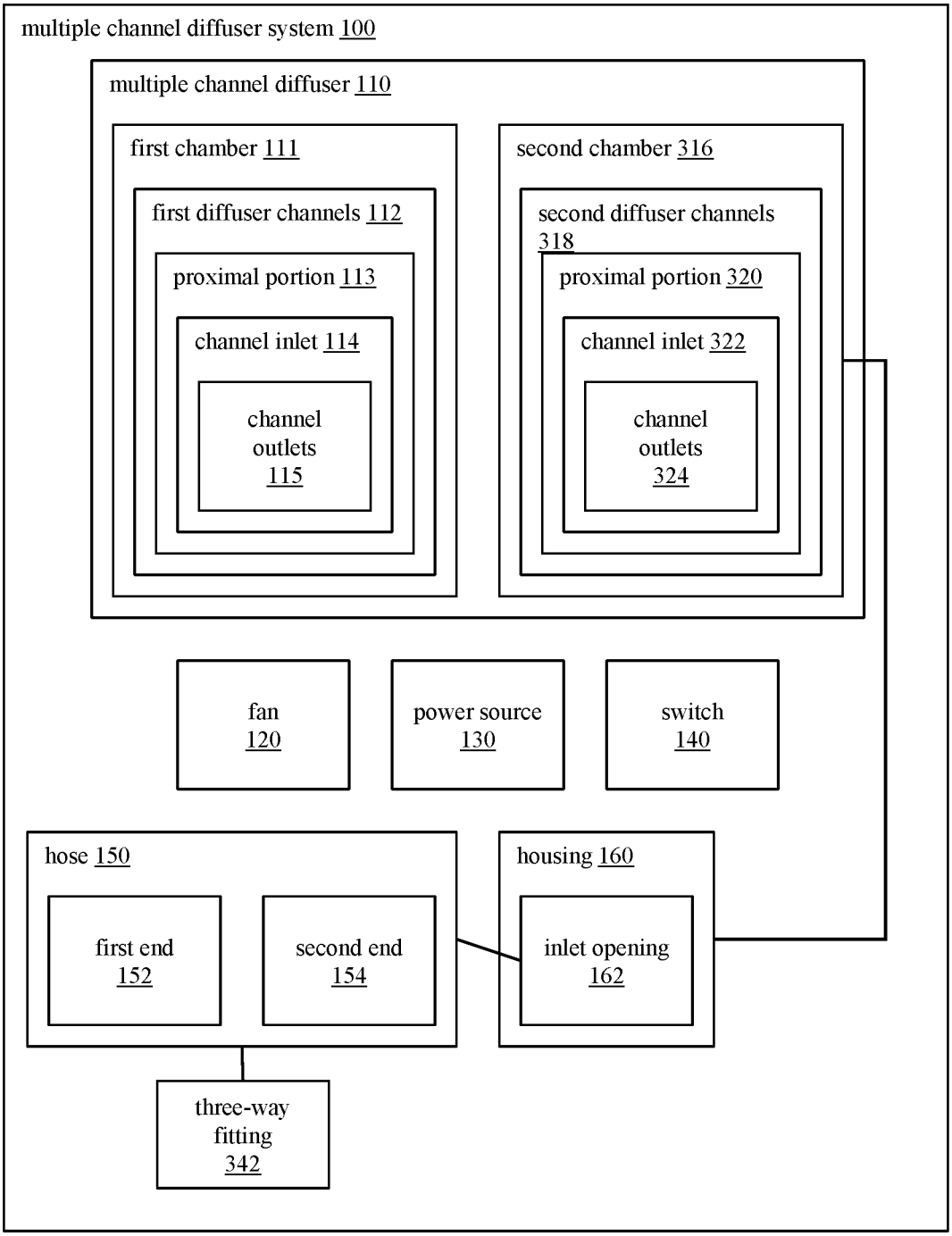
FIG. 3 is a block diagram further illustrating the multiple channel diffuser system from FIG. 1, according to some embodiments of the present disclosure.

FIG. 3 is a block diagram that further describes the multiple channel diffuser system 100 from FIG. 1, according to some embodiments of the present disclosure. In some embodiments, the multiple channel diffuser 110 may include a second chamber 316 in communication with the inlet opening of the housing 160. The second chamber 316 may include one or more second diffuser channels 318 disposed on the second chamber 316. The one or more second diffuser channels 318 may include a proximal portion 320 located opposite a distal portion. The one or more second diffuser channels 318 each have a proximal portion located opposite a distal portion. The proximal portion 320 may also include a channel inlet 322 located on the second chamber 316. The one or more second diffuser channels 318 each have a proximal portion located opposite a distal portion. The proximal portion 320 of the one or more second diffuser channels 318 each have a channel inlet 322. The one or more second diffuser channels 318 may include one or more channel outlets 324. In some embodiments, the multiple channel diffuser system 100 may also include a three-way fitting 342. The three-way fitting may be connected to the hose 150. The second chamber 316 of the multiple channel diffuser 110 may be in communication with at least a portion of the three-way fitting 342.

Figure 4:
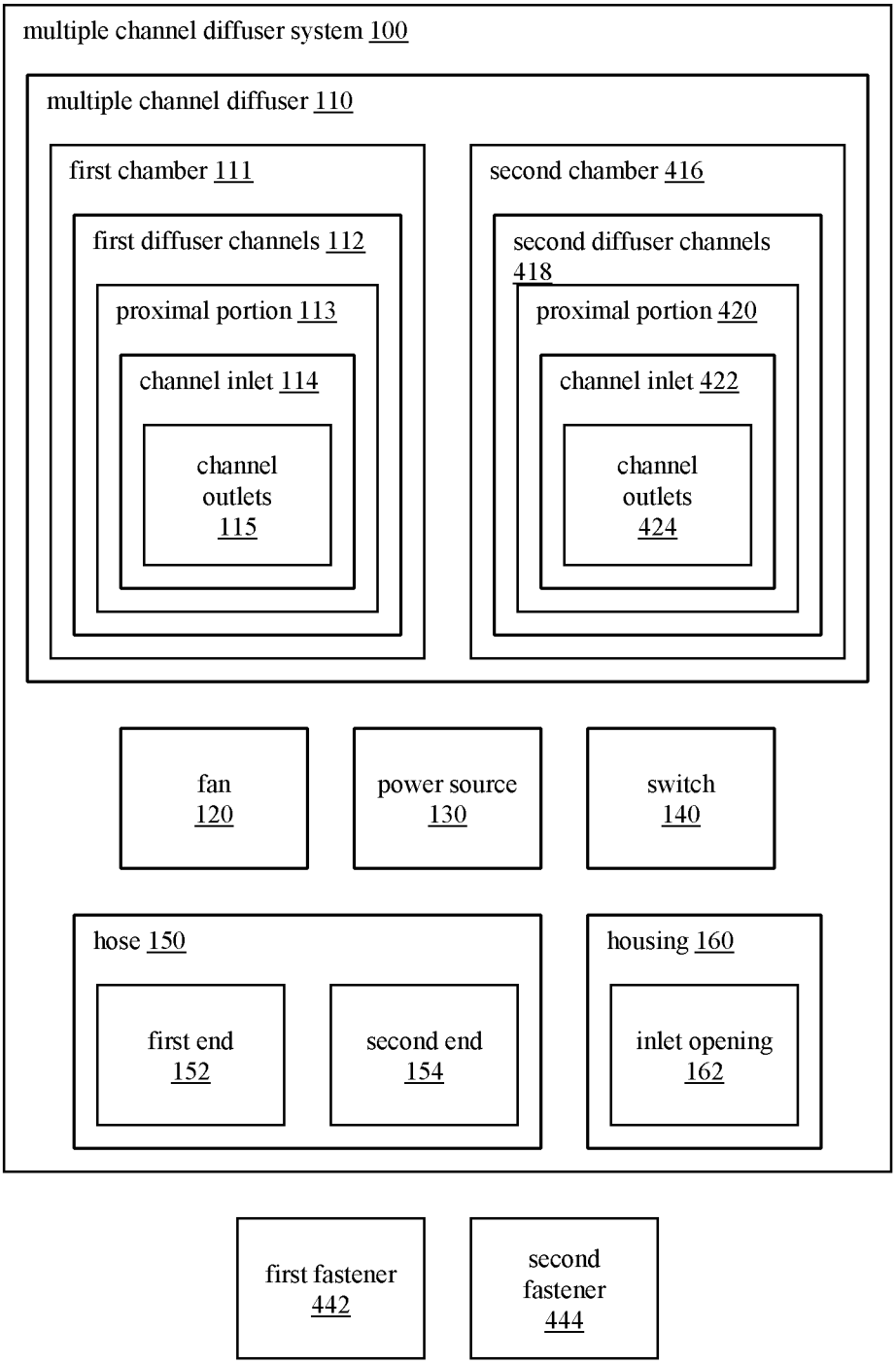
FIG. 4 is a block diagram further illustrating the multiple channel diffuser system from FIG. 1, according to some embodiments of the present disclosure.

FIG. 4 is a block diagram that further describes the multiple channel diffuser system 100 from FIG. 1, according to some embodiments of the present disclosure. In some embodiments, the multiple channel diffuser 110 may include a second chamber 316 in communication with the inlet opening of the housing 160. The second chamber 316 may include one or more second diffuser channels 318 disposed on the second chamber 316. The one or more second diffuser channels 318 may include a proximal portion 320 located opposite a distal portion. The one or more second diffuser channels 318 each have a proximal portion 320 that may include a channel inlet 322 located on the second chamber 316. The one or more second diffuser channels 318 each have a proximal portion 320 having a channel inlet 322. The one or more second diffuser channels may include one or more channel outlets 324.

In some embodiments, the distal portion of the one or more second diffuser channels 318 may be removably connected to the distal portion of the one or more first diffuser channels 112. The first fastener 442 of the one or more first diffuser channels 112 may be configured to connect to the second fastener 444 of the one or more second diffuser channels 318. It is within the scope of this invention for a fastener to include, but not be limited to, a snap, a magnet, a latch, and/or any locking mechanism.

FIG. 4 shows second chamber 416 having second diffuser channels 418 having proximal portion 420 connected to channel inlet 422. Second diffuser channels 418 may have a plurality of channel outlets 424.

Figure 5:
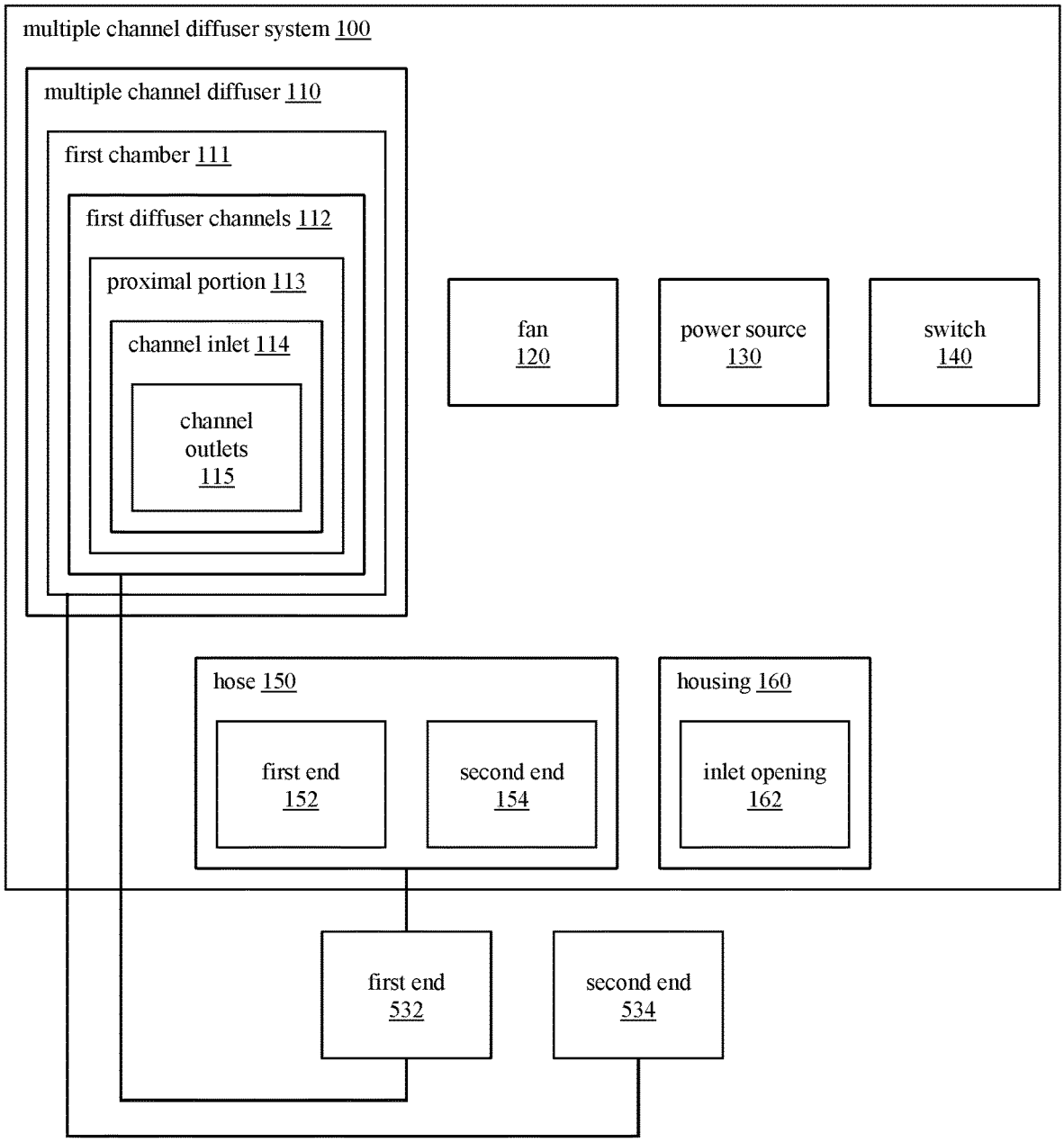
FIG. 5 is a block diagram further illustrating the multiple channel diffuser system from FIG. 1, according to some embodiments of the present disclosure.

FIG. 5 is a block diagram that further describes the multiple channel diffuser system 100 from FIG. 1, according to some embodiments of the present disclosure. In some embodiments, the first chamber 111 of the multiple channel diffuser 110 includes a first chamber 111 having a first end 532 and a second end 534. The first end 532 of the first chamber 111 of the multiple channel diffuser 110 has a first inlet opening configured to connect to the flexible hose.

Figure 6:
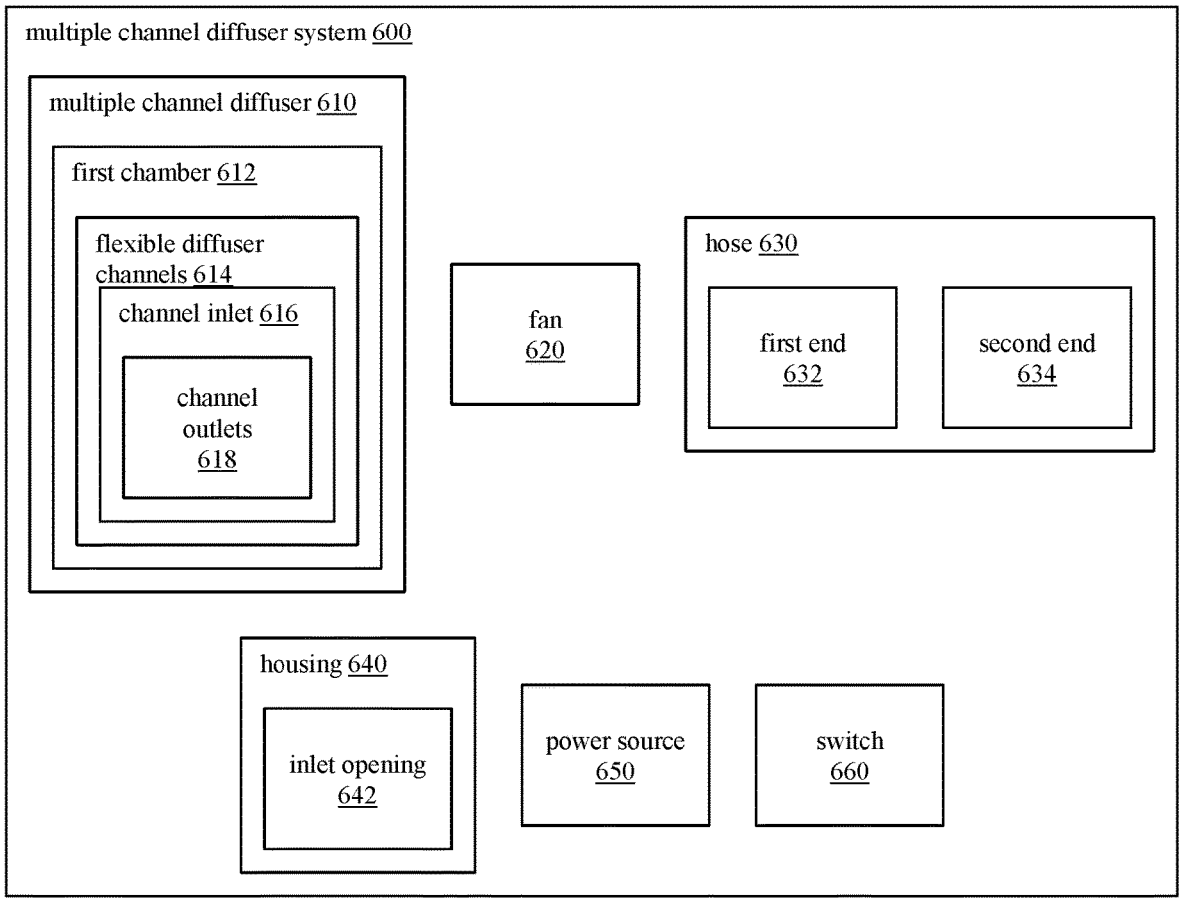
FIG. 6 is a block diagram illustrating a multiple channel diffuser system, according to some embodiments of the present disclosure.

FIG. 6 is a block diagram that describes a multiple channel diffuser system 600, according to some embodiments of the present disclosure. In some embodiments, the multiple channel diffuser system 600 may include a multiple channel diffuser 610, a hose 630, and a housing 640 retaining the fan 620. The multiple channel diffuser system 600 may also include a fan 620 connected to a motor. The multiple channel diffuser system 600 may also include a power source 650 electrically connected to the motor of the fan 620. The multiple channel diffuser system 600 may also include a switch 660 electrically connected to the power source 650.

In some embodiments, the multiple channel diffuser 610 may include a first chamber 612. The first chamber 612 may include a plurality of flexible diffuser channels 614 disposed on the first chamber 612. The plurality of flexible diffuser channels 614 may include a channel inlet 616 located proximal to the first chamber 612. The plurality of flexible diffuser channels 614 each have channel inlet 616 and may include a plurality of channel outlets 618 traversing a length of the plurality of flexible diffuser channels 614.

In some embodiments, the hose 630 may include a first end 632 and a second end 634. The housing 640 may include an inlet opening 642. The first end 632 of the hose 630 may be connected to the inlet opening of the housing 640. The inlet opening of the housing 640 may be configured to receive air from the fan 620 and discharge the air into the first chamber 612 of the multiple channel diffuser 610. The plurality of flexible diffuser channels 614 may be configured to discharge the air from the first chamber 612 of the multiple channel diffuser 610 to the scalp of the user.

In some embodiments, the plurality of channel outlets 618 of the plurality of flexible diffuser channels 614 may be configured to overlay at least a portion of the head of the user when the multiple channel diffuser 610 is worn on the head of the user. In some embodiments, the plurality of channel outlets 618 of the plurality of flexible diffuser channels 614 may be configured to overlay at least a portion of the scalp of the user when at least a portion of the multiple channel diffuser 610 is worn under a portion of hair of the user.

Figure 7:
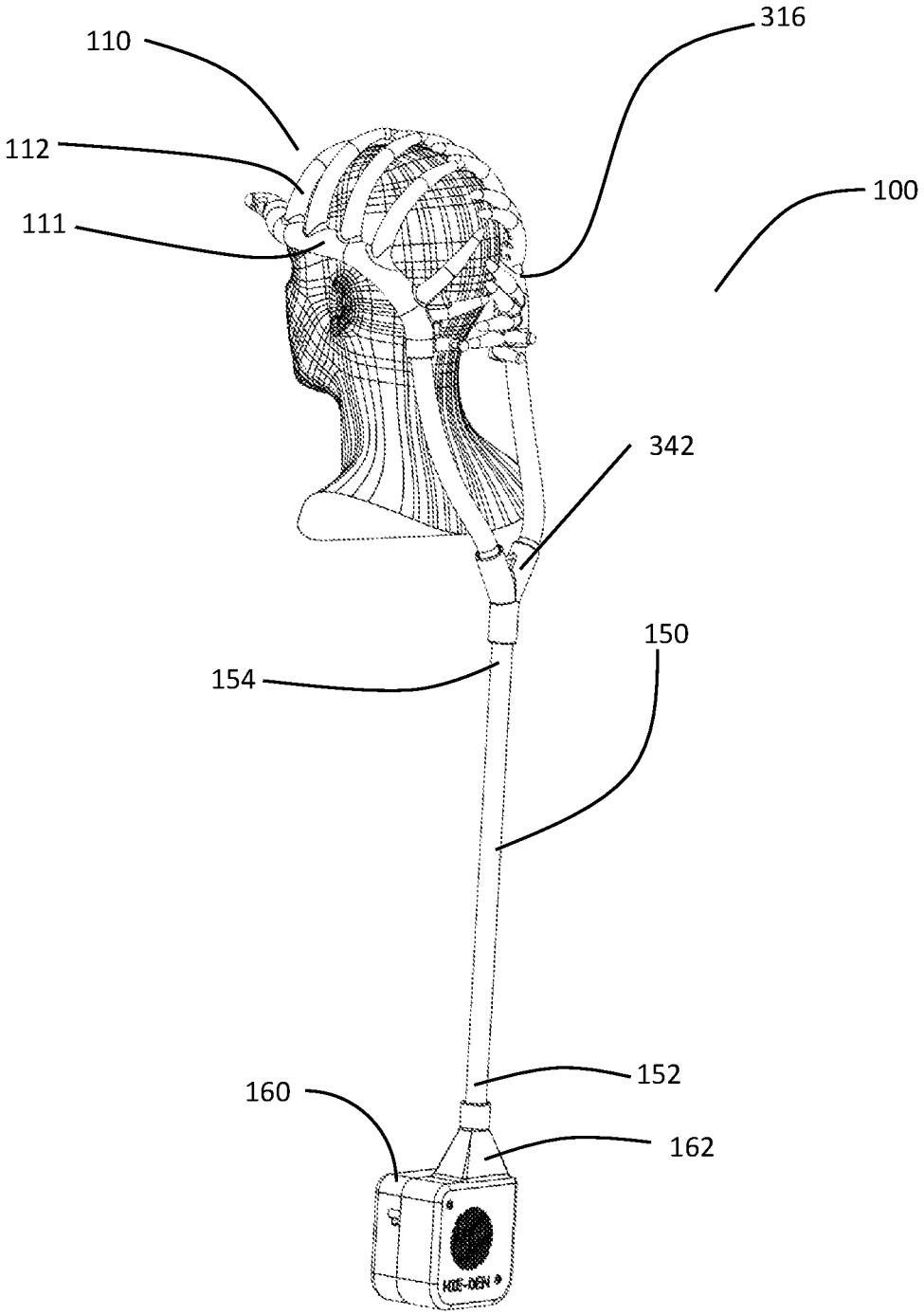
FIG. 7 is a rear perspective view of the multiple channel diffuser system having a multiple channel diffuser connected to a housing, according to some embodiments of the present disclosure.
Figure 19:
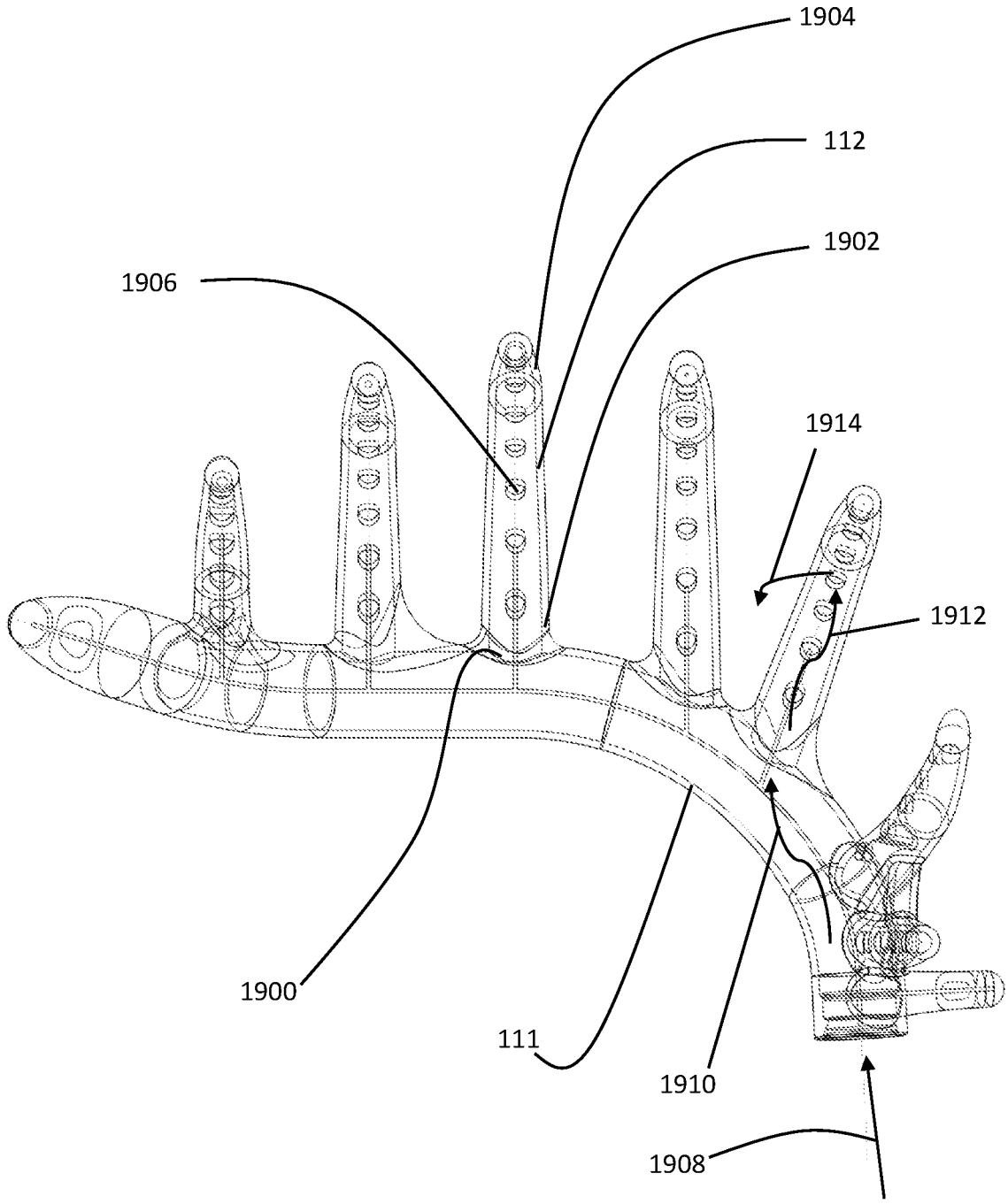
FIG. 19 is a perspective view of a first chamber including a plurality of flexible diffuser channels, according to some embodiments of the present disclosure.
Figure 20:
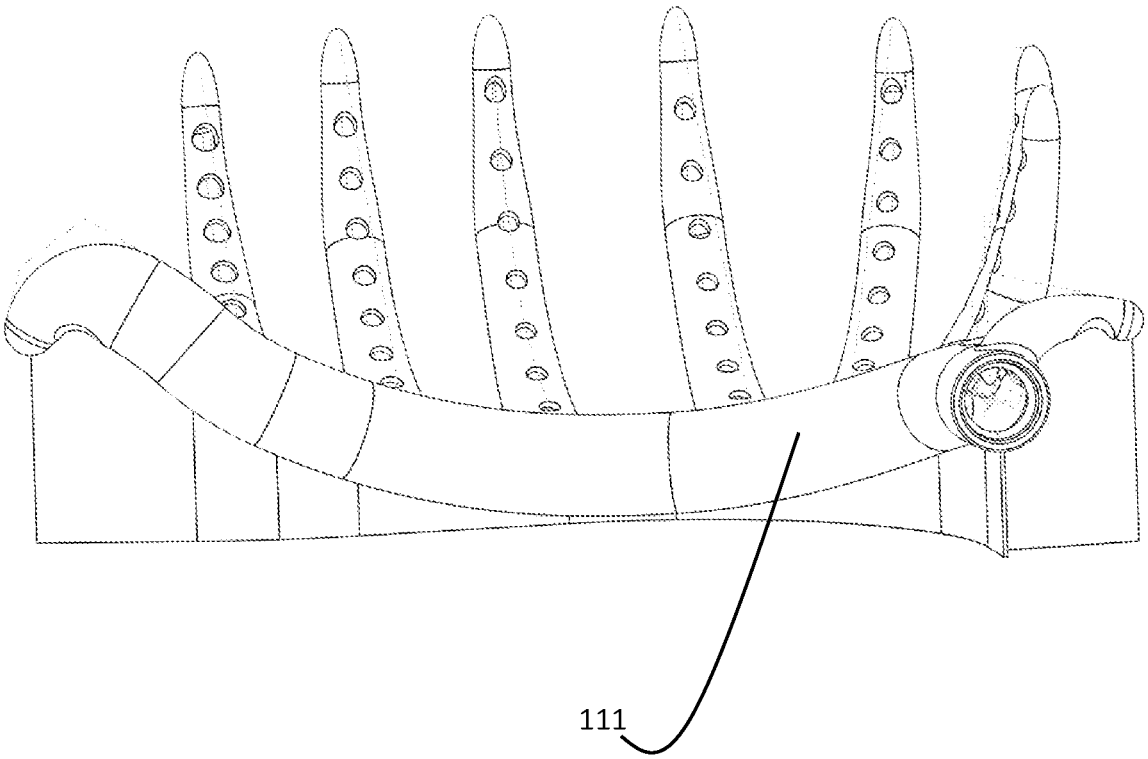
FIG. 20 is a perspective view of a first chamber including a plurality of flexible diffuser channels each having a plurality of channel outlets, according to some embodiments of the present disclosure.
Figure 21:
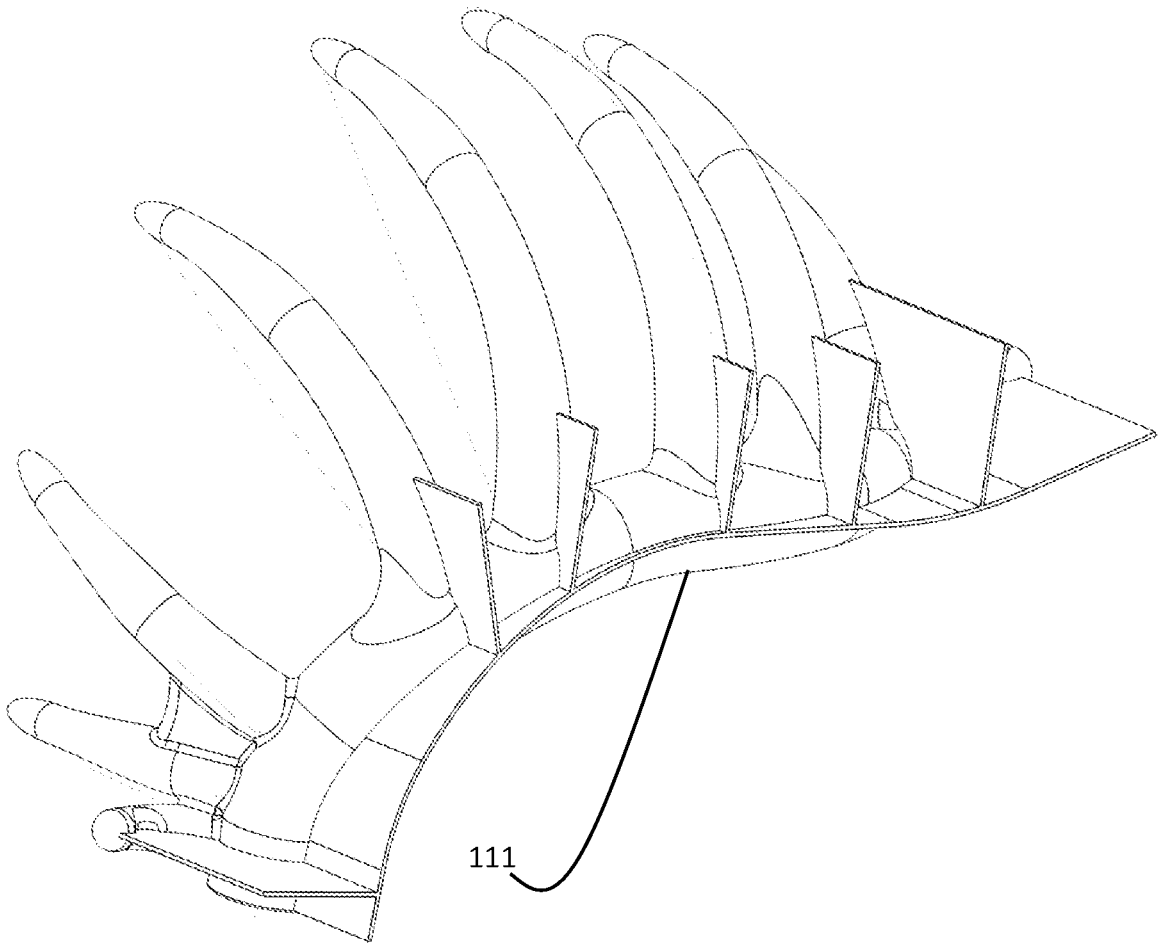
FIG. 21 is a perspective view of a first chamber including a plurality of flexible diffuser channels, according to some embodiments of the present disclosure.
Figure 22:
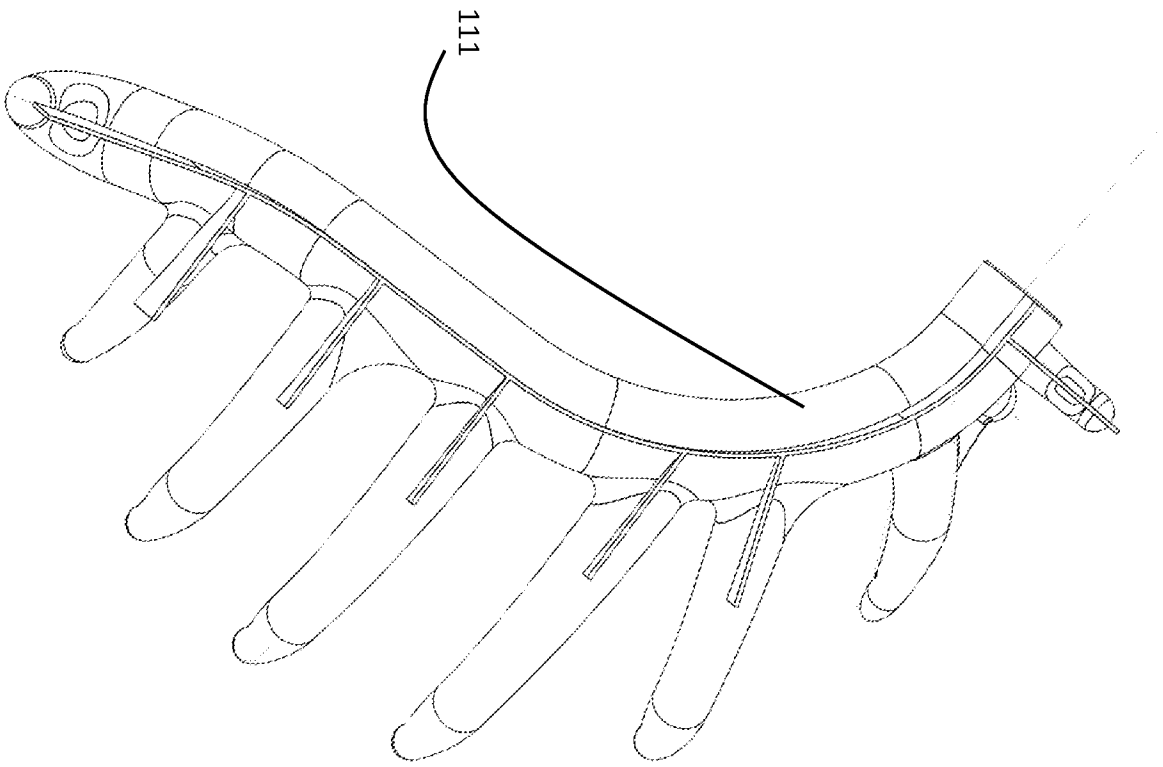
FIG. 22 is a perspective view of a first chamber including a plurality of flexible diffuser channels each having a channel inlet located on the first chamber and a plurality of channel outlets, according to some embodiments of the present disclosure.

FIG. 7 is a rear perspective view of the multiple channel diffuser system 100 having a multiple channel diffuser 110 connected to a housing 160. Multiple channel diffuser 110 has first chamber 111 and second chamber 316. A third chamber 800 (FIG. 8) may be added to the system for additional diffuser channels. At least FIGS. 7 and 19 show plurality of first flexible diffuser channels 112 are disposed on first chamber 111. FIG. 19 best shows one or more first diffuser channels 112 each having proximal portion 1902 located opposite distal portion 1904. The distal portion of one or more second diffuser channels of second chamber 316 may be bent to be in alignment (not shown) with the distal portion 1904 of the one or more first flexible diffuser channels 112 and may be removably connected to the distal portion 1904 of the one or more first diffuser channels 112. The distal portion of one or more second diffuser channels of second chamber 316 may be oriented adjacent and/or next to the distal portion 1904 of the one or more first flexible diffuser channels 112. Referring again to FIG. 19, plurality of flexible diffuser channels 112 each have channel inlet 1900 located proximal to first chamber 111. Plurality of flexible diffuser channels 112 each having a plurality of channel outlets 1906 traversing a length of plurality of flexible diffuser channels 112.

FIG. 7 shows hose 150 having first end 152 and second end 154. First end 152 of hose 150 is connected to inlet opening 162 of housing 160. Multiple channel diffuser 110 has a second chamber 316 in communication with the inlet opening 162 of housing 160. Three-way fitting 342 may be connected to hose 150. Three-way fitting 342 includes, but is not limited to a T-valve and/or a Y-valve. A first portion of the three-way fitting 342 is connected to a first hose 150. A second portion of the three-way fitting is connected to a second hose. The second hose is connected to a port of the first chamber 111 of multiple channel diffuser 110. A third portion of the three-way fitting is connected to a third hose. The third hose is connected to a port of the second chamber 316 of multiple channel diffuser 110.

Figure 24:
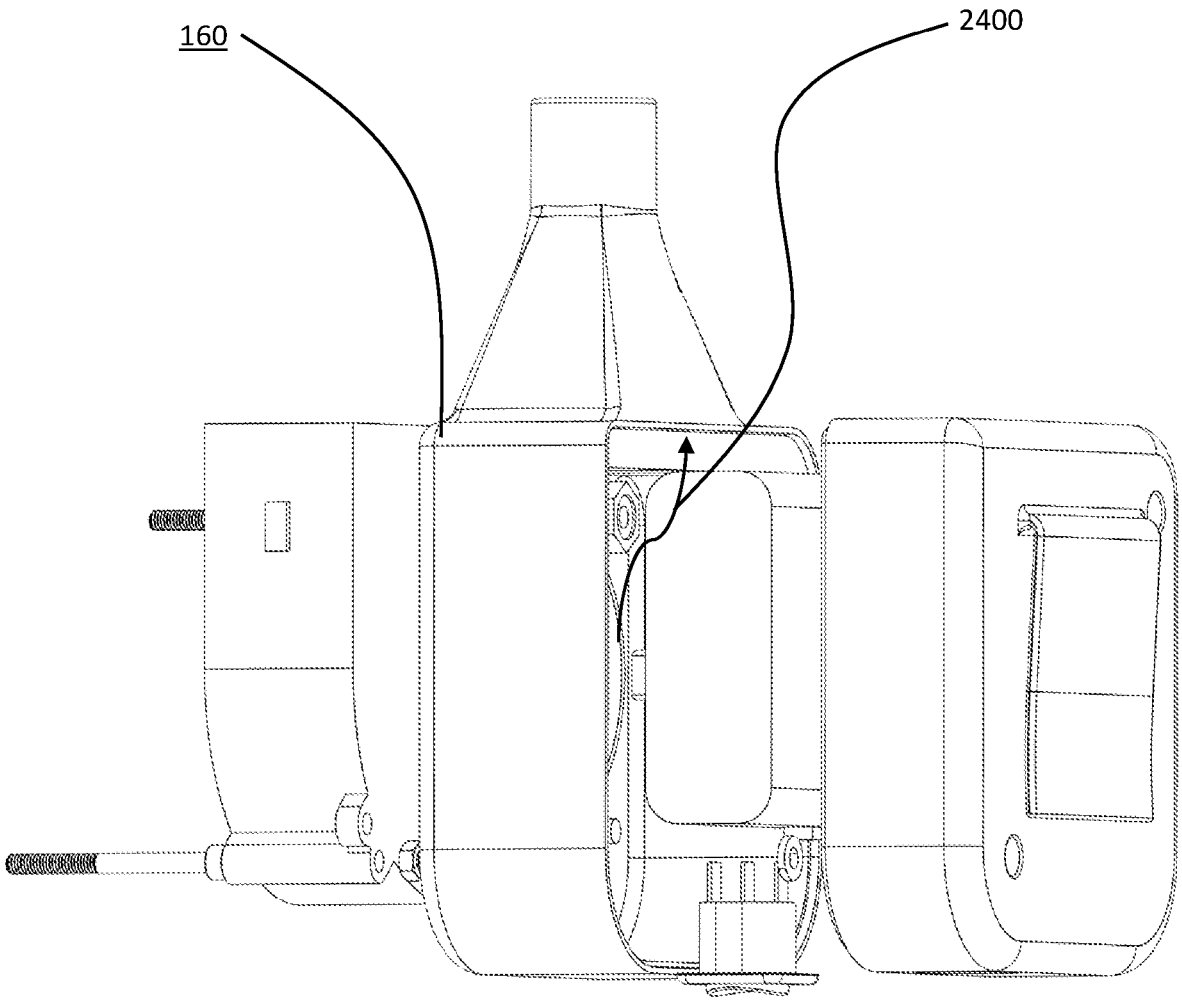
FIG. 24 is an exploded view of the housing configured to retain a fan, a battery, and a switch, according to some embodiments of the present disclosure.
Figure 25:
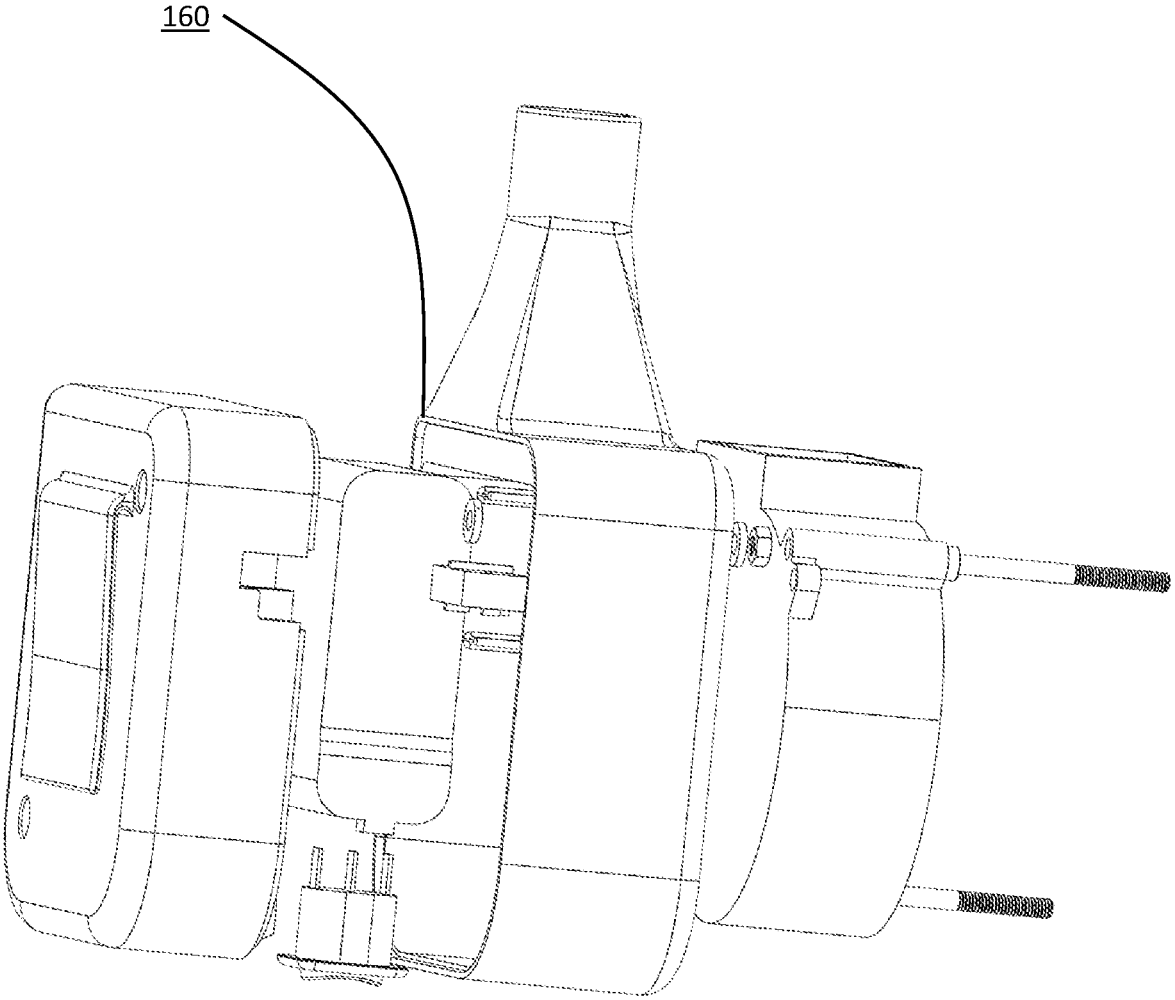
FIG. 25 is an exploded view of the housing configured to retain a fan, a battery, and a switch, according to some embodiments of the present disclosure.
Figure 26:
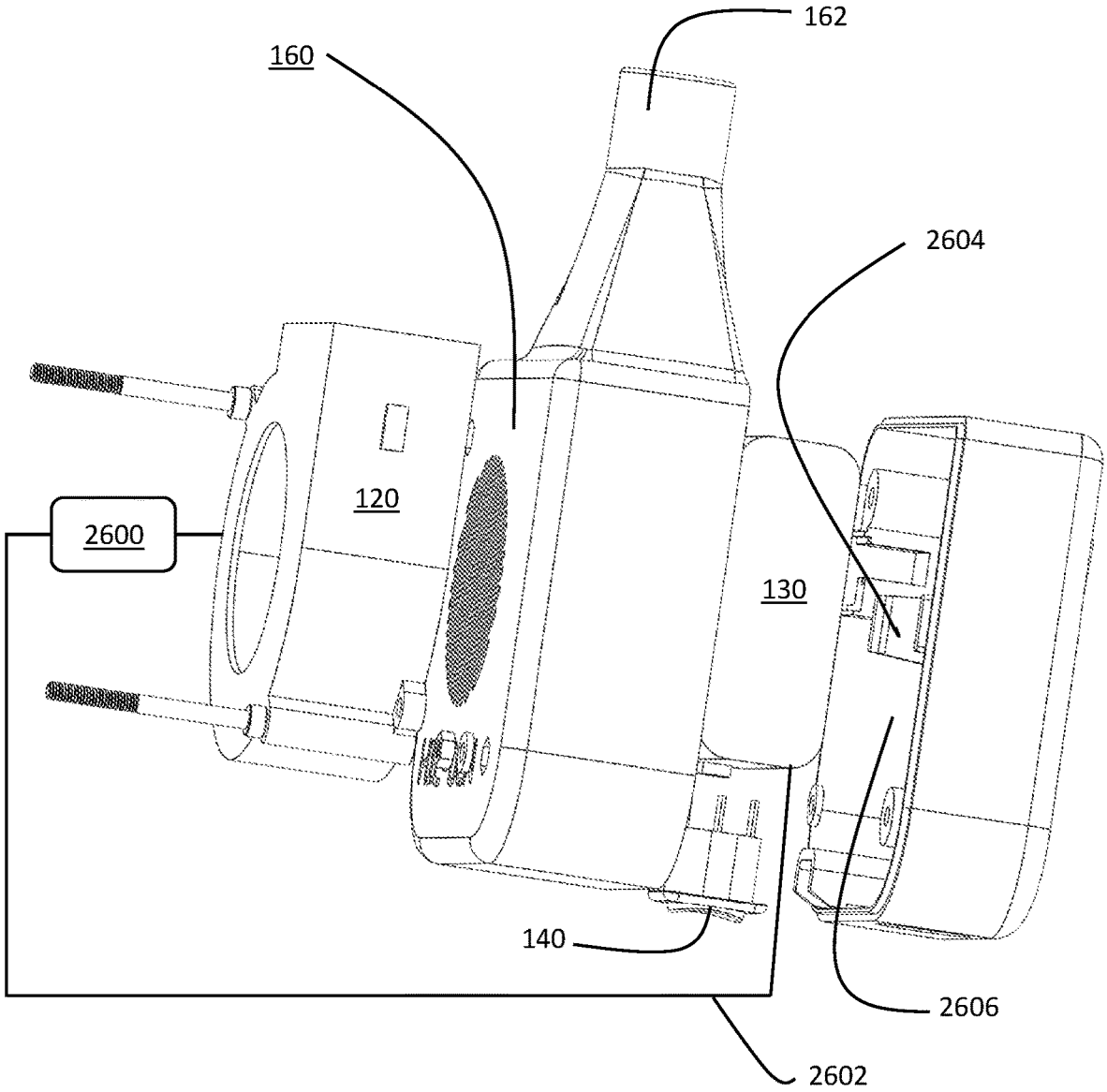
FIG. 26 is an exploded view of the housing configured to retain a fan, a battery, and a switch, according to some embodiments of the present disclosure.
Figure 27:
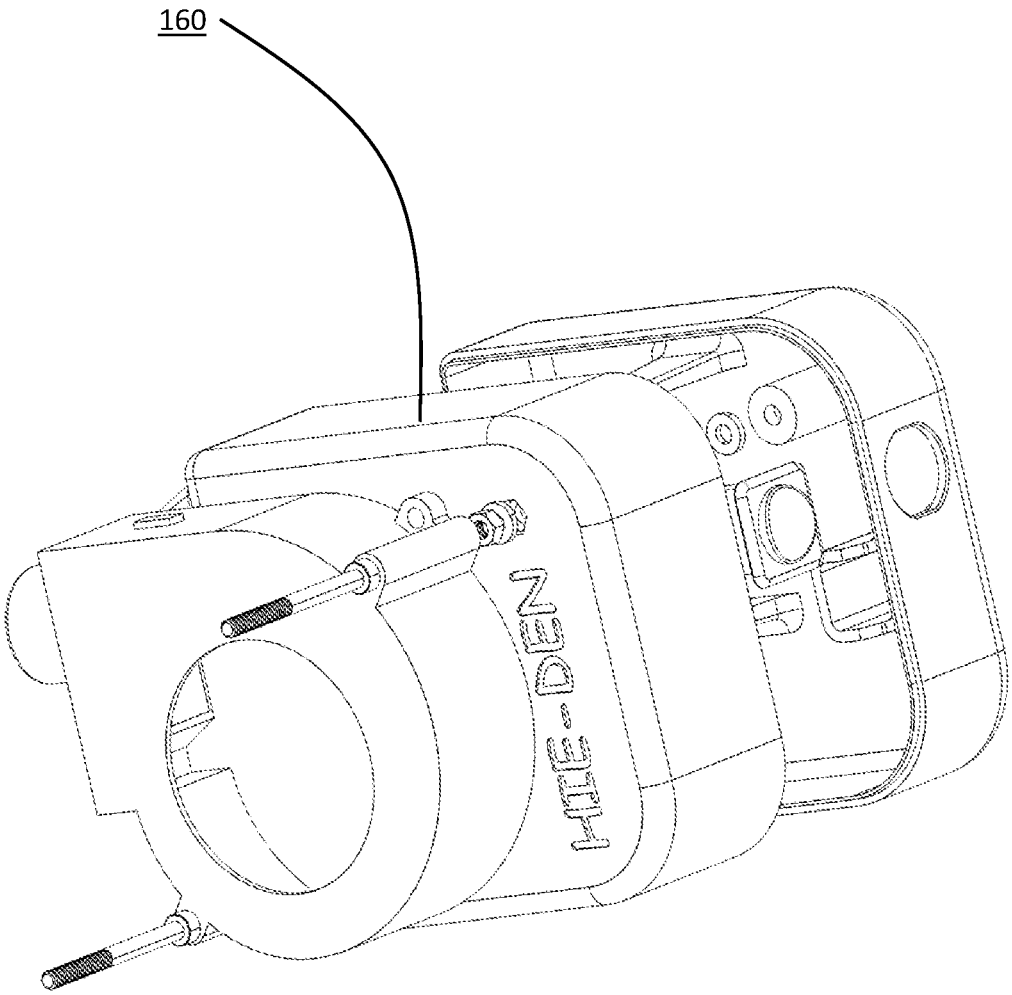
FIG. 27 is an exploded view of the housing configured to retain a fan, a battery, and a switch, according to some embodiments of the present disclosure.

FIG. 26 illustrates housing 160 is configured to retain fan 120. Fan 120 is driven by motor 2600. Power source 130 is electrically connected 2602 to motor 2600 of fan 120. Switch 140 is electrically connected to power source 130. It is within the scope of this invention for power source 130 to include, but not be limited to a battery, a generator, alternating current (AC), and/or direct current (DC). Housing 160 has inlet opening 162. Inlet opening 162 of housing 160 is configured to receive air 2400 (FIG. 24) from the fan and discharge the air 1908 (FIG. 19) into first chamber 111 (FIG. 19) of the multiple channel diffuser. Referring now to FIG. 19, air 1910 flows from first chamber 111, through at least one channel inlet 1900 to one or more flexible diffuser channels 112. Plurality of flexible diffuser channels 112 are configured to discharge the air 1912 from first chamber 111 of the multiple channel diffuser via one or more channel outlets 1906. Air 1914 is dispensed from one or more channel outlets 1906 of flexible diffuser channels 112 to the scalp of the user (not shown). Support structure 2604 extending from inner wall surface 2606 of housing 160. Support structure 2604 is configured to retain power source 130.

Figure 8:
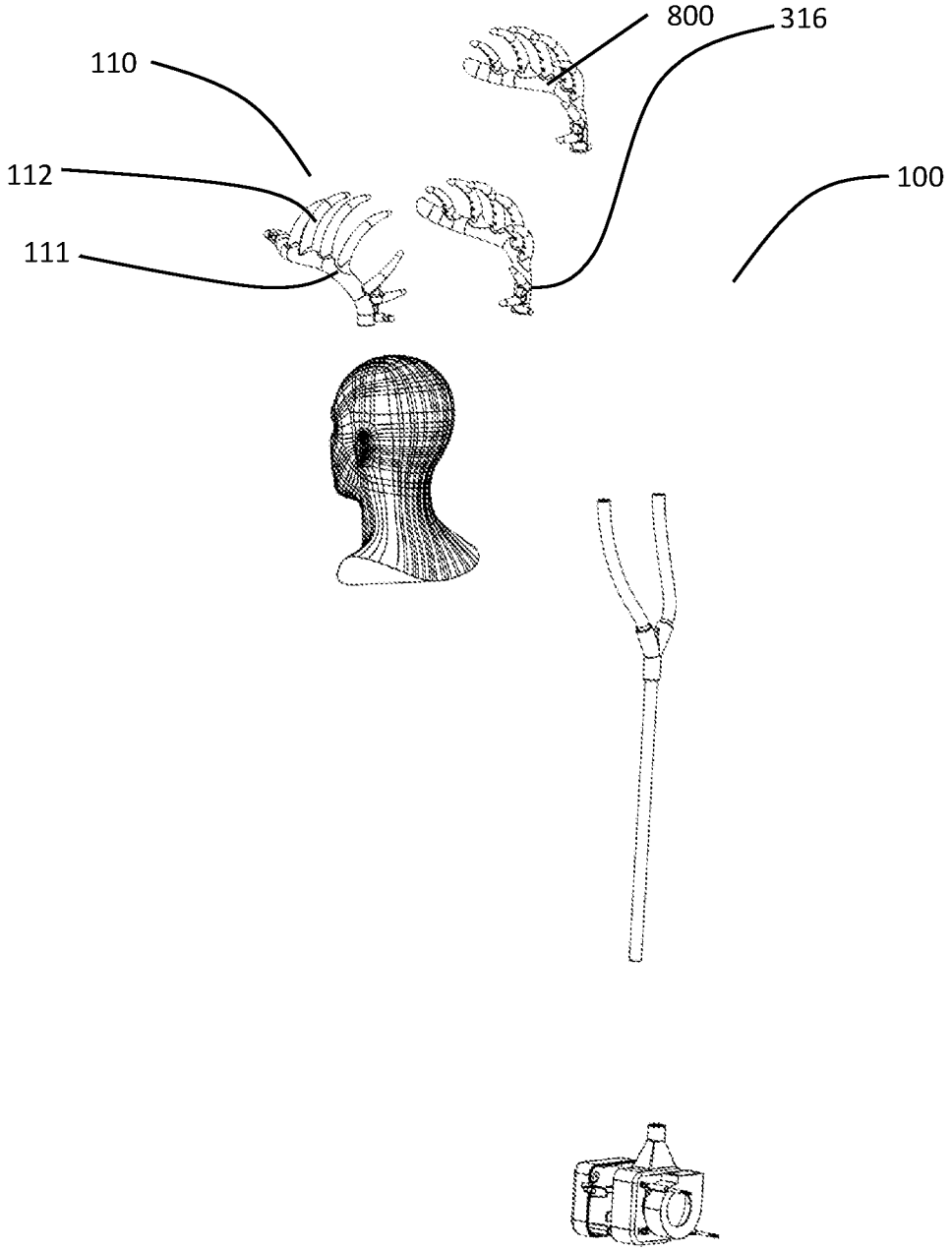
FIG. 8 is a rear exploded view of the multiple channel diffuser system having a multiple channel diffuser including a first chamber and a second chamber configured to connect to a hose adapted to couple to a housing retaining a fan, according to some embodiments of the present disclosure.
Figure 9:
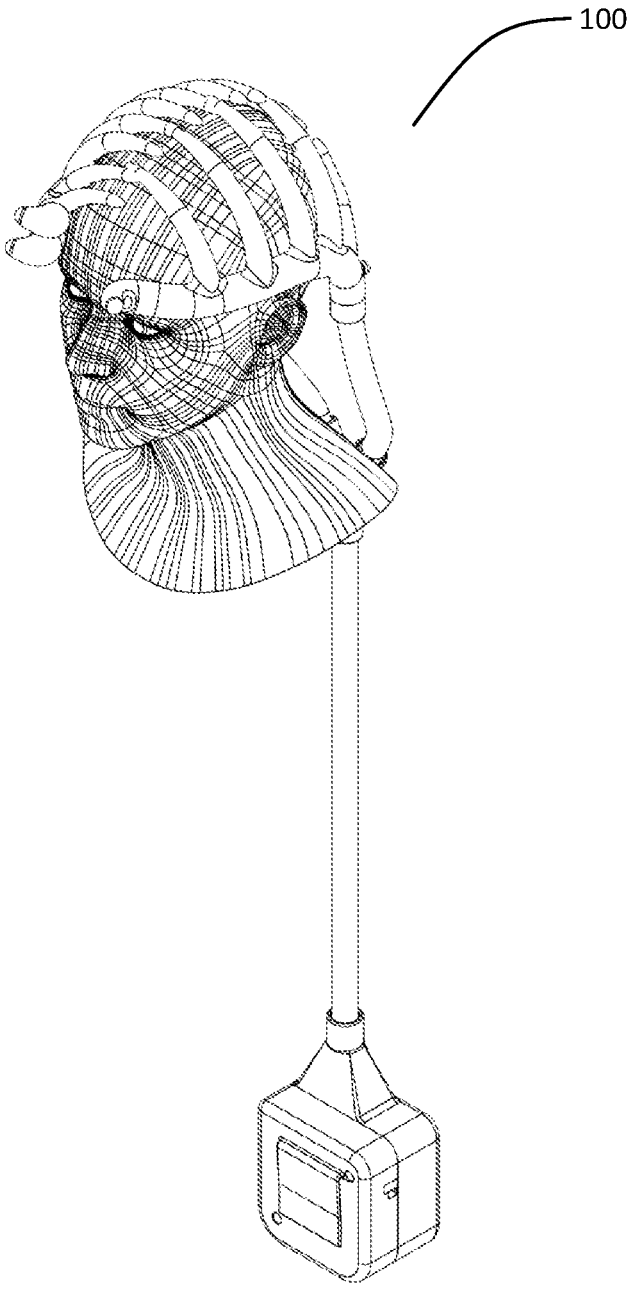
FIG. 9 is a front perspective view of the multiple channel diffuser system having a multiple channel diffuser connected to a housing having a clip, according to some embodiments of the present disclosure.
Figure 10:
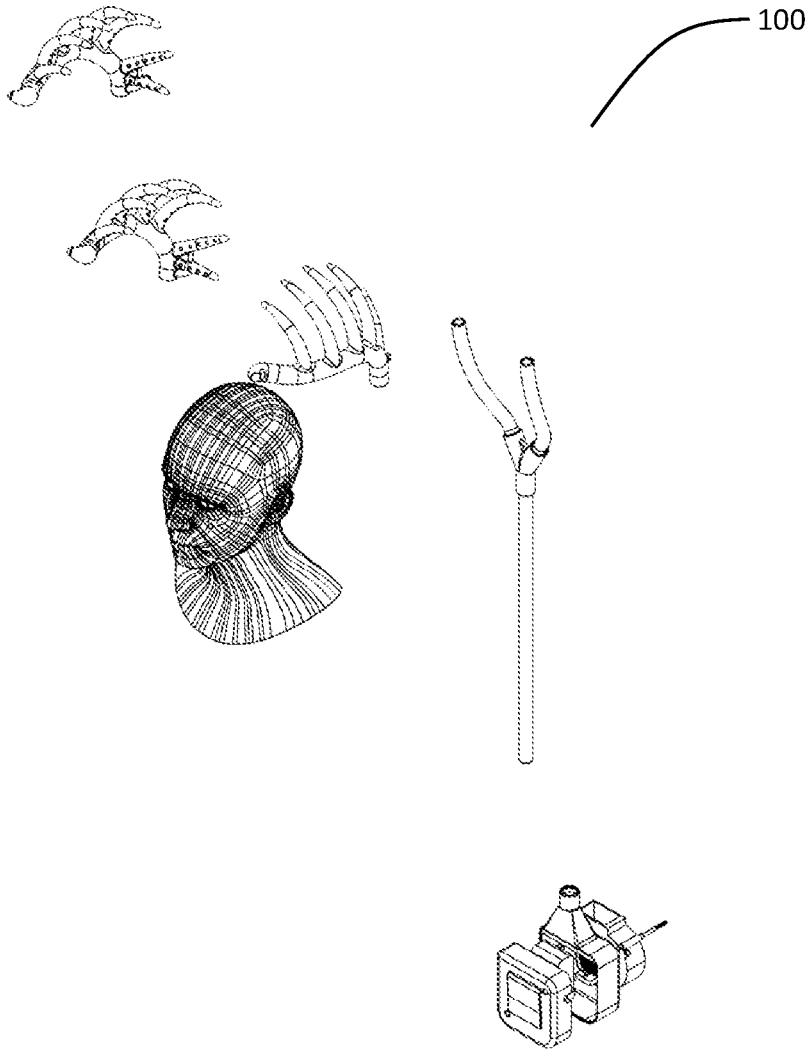
FIG. 10 is a front exploded view of the multiple channel diffuser system having a multiple channel diffuser including a first chamber and a second chamber configured to connect to a hose adapted to couple to a housing retaining a fan, according to some embodiments of the present disclosure.
Figure 11:
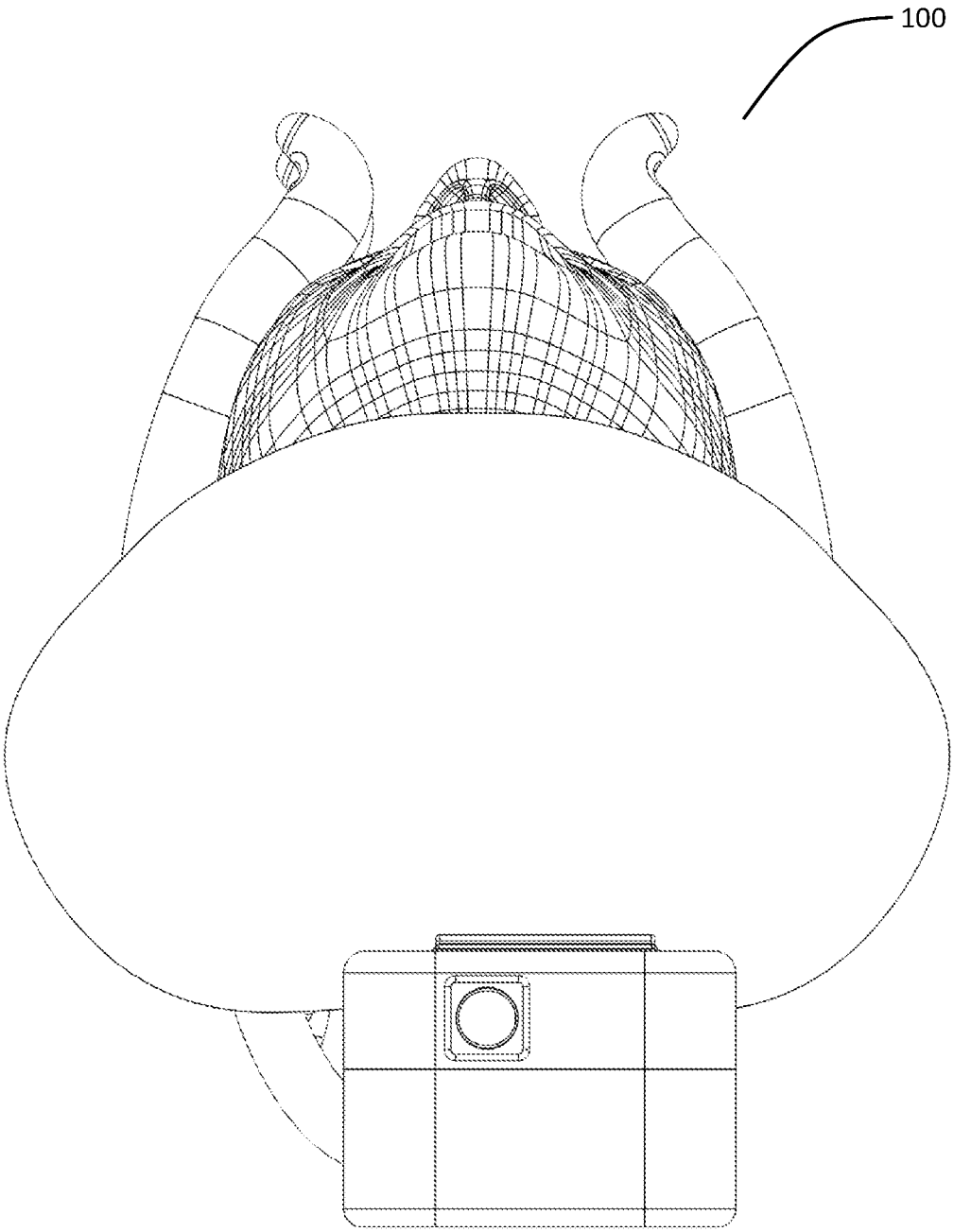
FIG. 11 is a bottom perspective view of the multiple channel diffuser system having a multiple channel diffuser connected to a housing including a button for a switch, according to some embodiments of the present disclosure.
Figure 12:
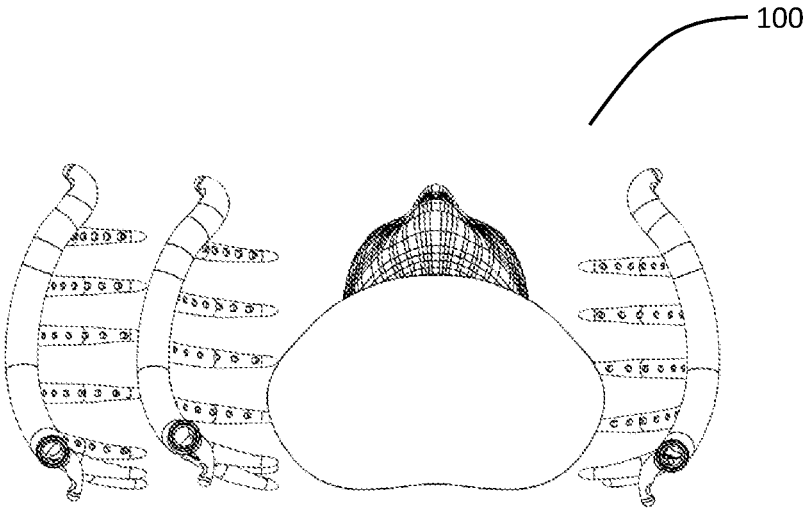
FIG. 12 is a bottom exploded view of the multiple channel diffuser system having a multiple channel diffuser including a first chamber and a second chamber configured to connect to a hose adapted to couple to a housing retaining a fan and a battery, according to some embodiments of the present disclosure.
Figure 12:
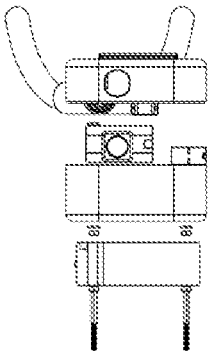
Figure 13:
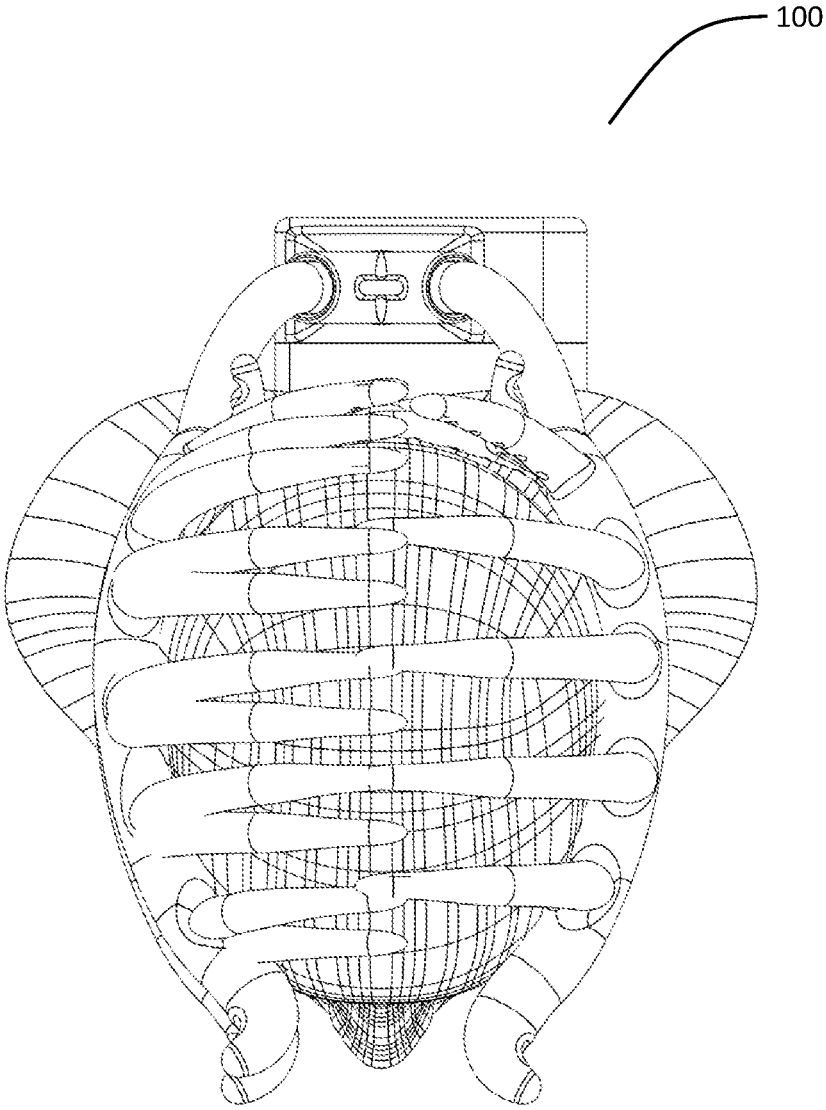
FIG. 13 is a top perspective view of the multiple channel diffuser system having a multiple channel diffuser connected to a housing, according to some embodiments of the present disclosure.
Figure 14:
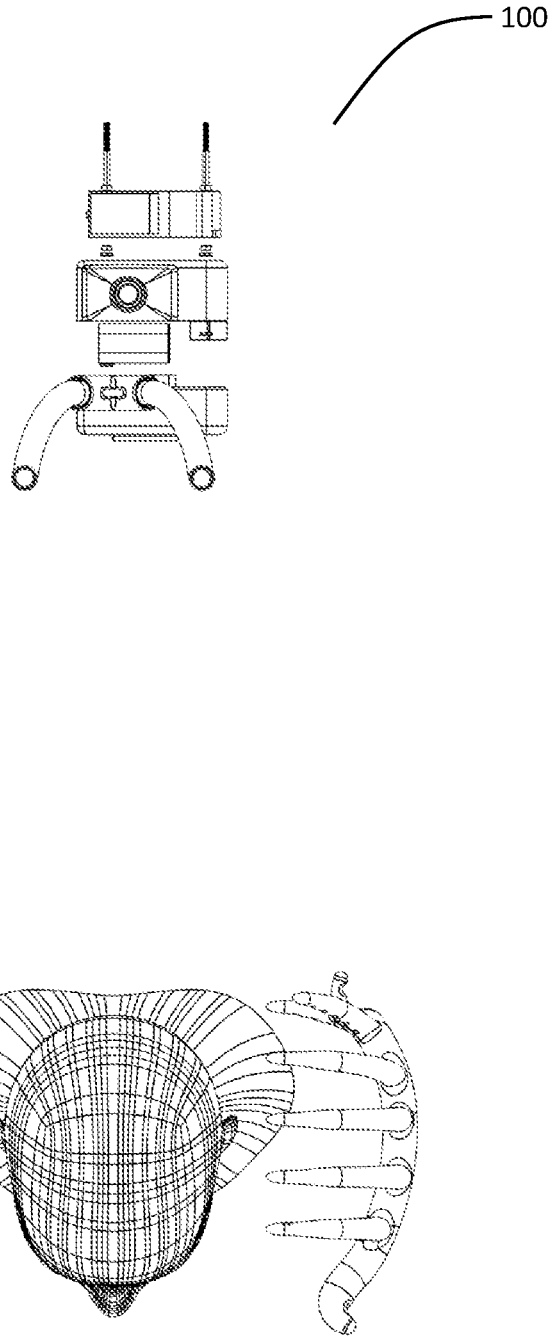
FIG. 14 is a top exploded view of the multiple channel diffuser system having a multiple channel diffuser including a first chamber and a second chamber configured to connect to a hose adapted to couple to a housing retaining a fan and a battery, according to some embodiments of the present disclosure.
Figure 15:
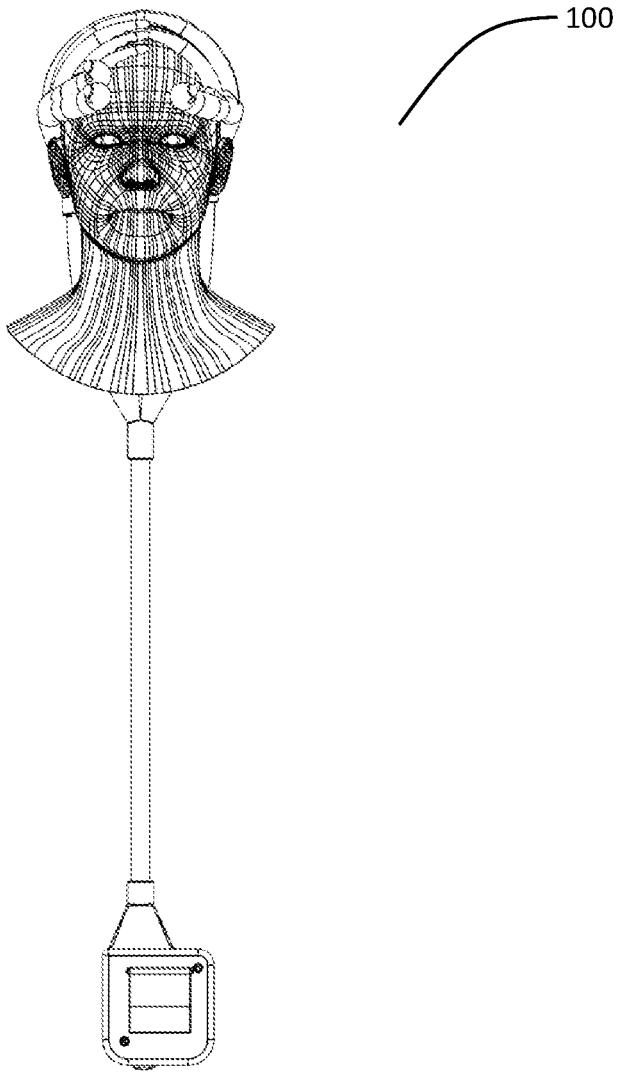
FIG. 15 is a front perspective view of the multiple channel diffuser system having a multiple channel diffuser connected to a housing, according to some embodiments of the present disclosure.
Figure 16:
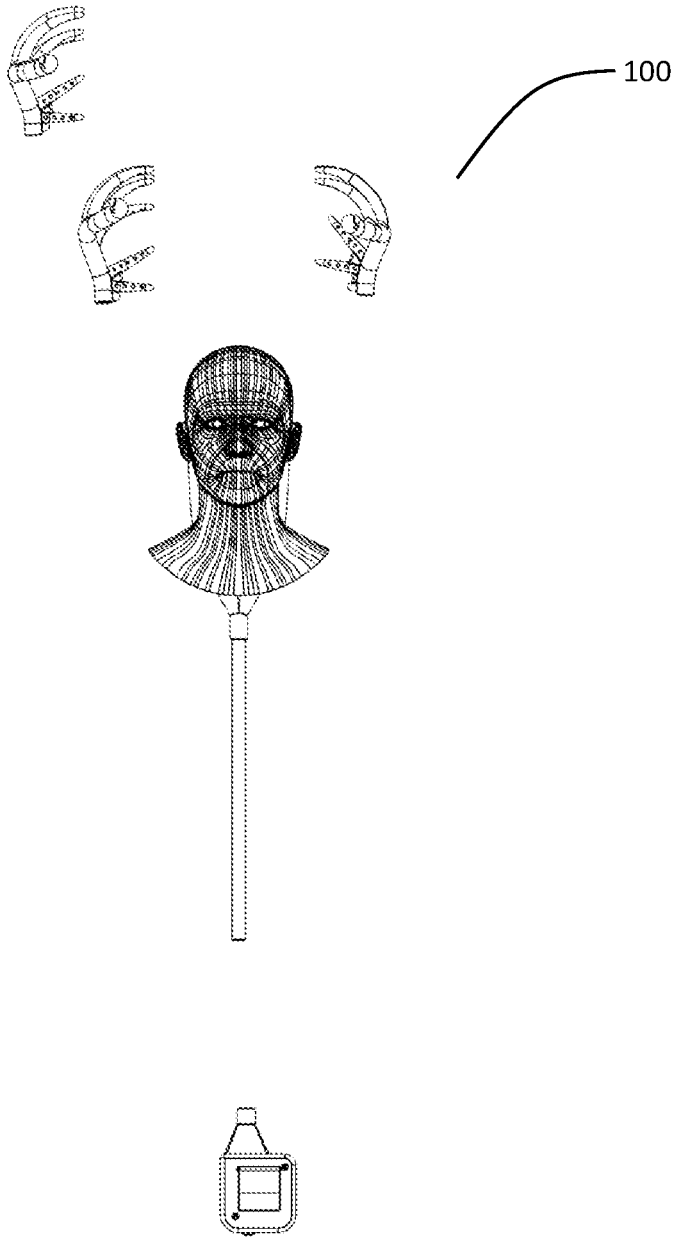
FIG. 16 is a front exploded view of the multiple channel diffuser system having a multiple channel diffuser including a first chamber and a second chamber configured to connect to a hose adapted to couple to a housing, according to some embodiments of the present disclosure.
Figure 17:
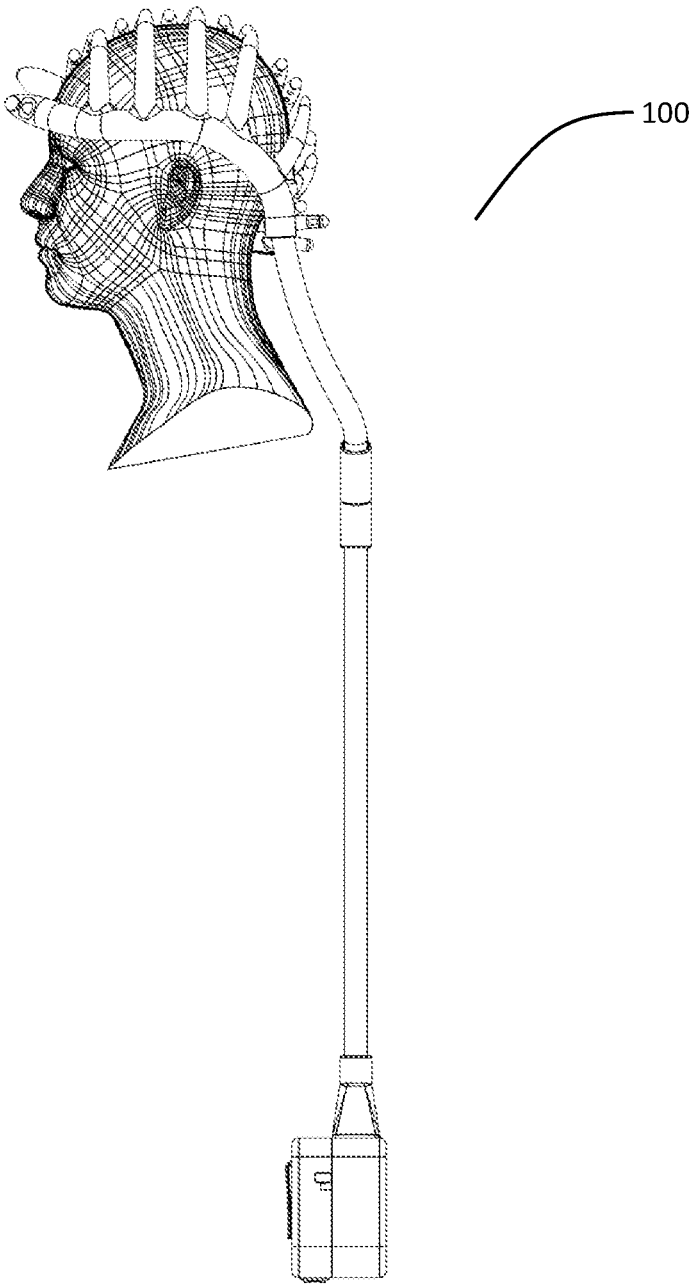
FIG. 17 is a left perspective view of the multiple channel diffuser system having a multiple channel diffuser connected to a housing, according to some embodiments of the present disclosure.
Figure 18:
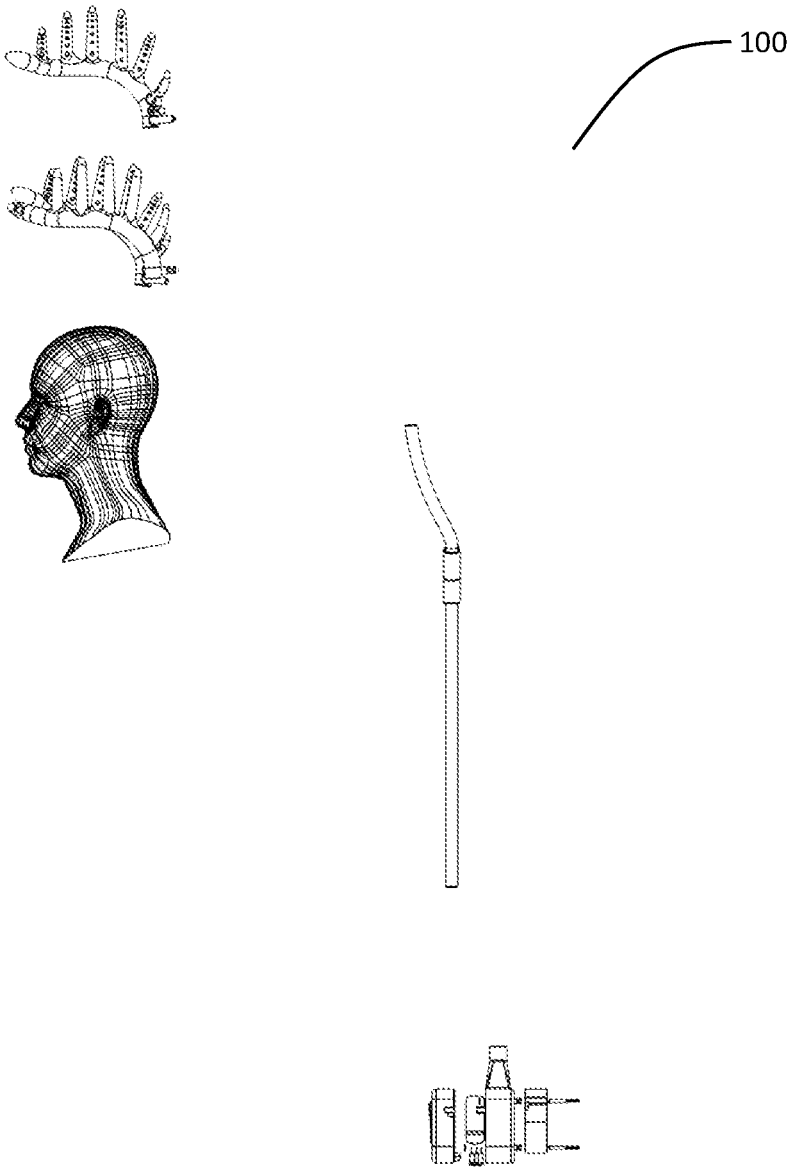
FIG. 18 is a left exploded view of the multiple channel diffuser system having a multiple channel diffuser including a first chamber and a second chamber configured to connect to a hose adapted to couple to a housing, according to some embodiments of the present disclosure.

FIG. 8 illustrates multiple channel diffuser system 100 having a multiple channel diffuser 110 having first chamber 111 and second chamber 316. FIG. 8 shows third chamber 800 may be added to the system for additional diffuser channels. At least FIGS. 7 and 19 show plurality of first flexible diffuser channels 112 are disposed on first chamber 111.

FIGS. 9, 10, 11, 12, 13, 14, 15, 16, 17, and 18 illustrate multiple channel diffuser system 100 of at least FIG. 7.

FIGS. 19, 20, 21, and 22 illustrate first chamber 111 of at least FIG. 7.

Figure 23:
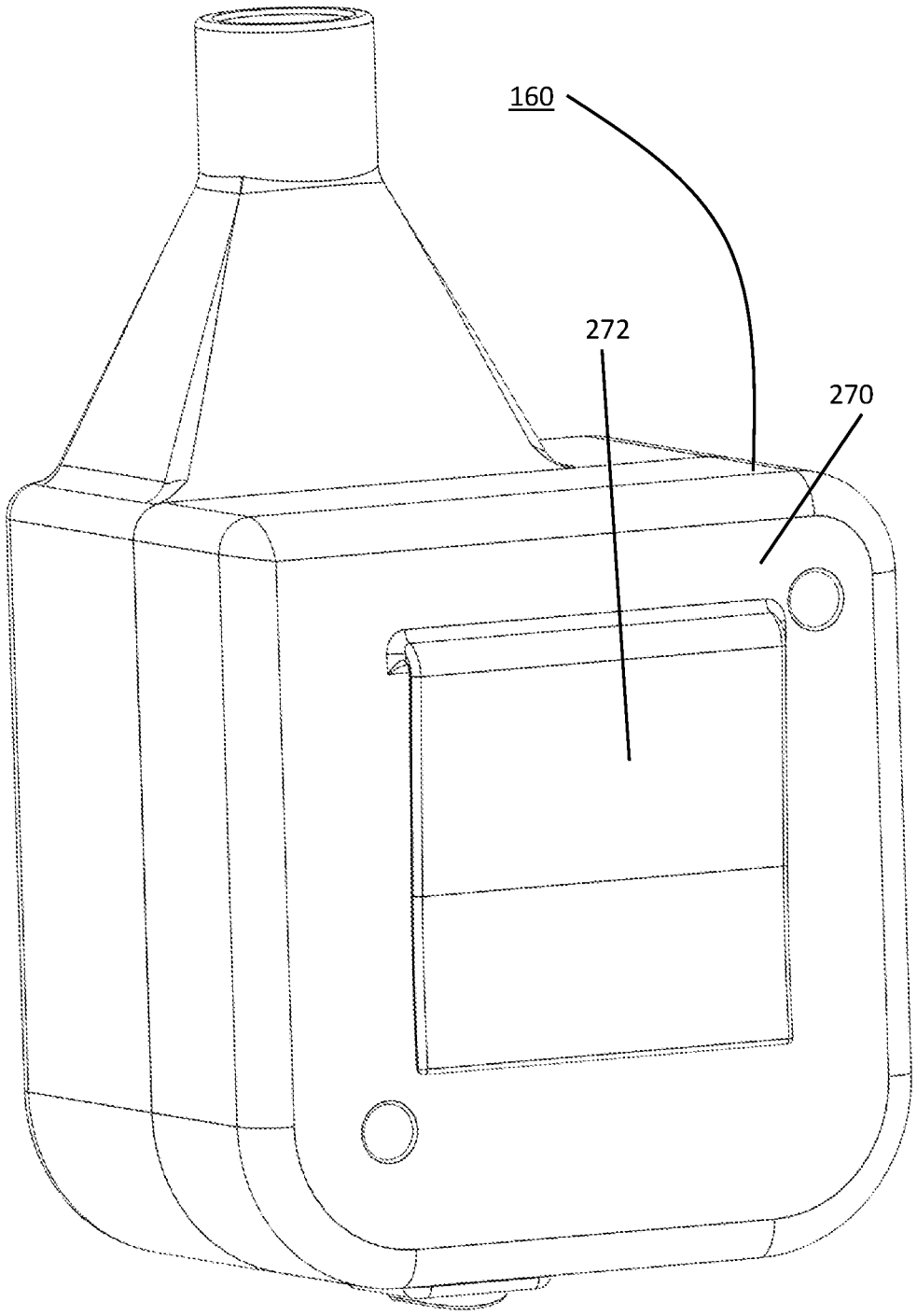
FIG. 23 is a rear perspective view of the housing having a clip, according to some embodiments of the present disclosure.

FIGS. 23, 24, 25, 26, and 27 illustrate housing 160 of at least FIG. 7 is a bottom exploded view of the multiple channel diffuser system having a multiple channel diffuser including a first chamber and a second chamber configured to connect to a hose adapted to couple to a housing retaining a fan and a battery, according to some embodiments of the present disclosure. FIG. 23 shows housing 160 having outer wall surface 270 with clip 272 connected thereto.

A. DEFINITIONS

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this invention belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated by some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the invention as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

ADDITIONAL DESCRIPTION

As described above, the present disclosure relates, in various aspects, to a novel scalp cooling system having two "antler"-like structures/halves with holes for jettison of air onto a user/wear's head/scalp will be the patentable element of the invention. The usages/what the device is used (referred to as "intended use") is not a reason for patentability because intended use can't be rejected under the intended use case law. Simply stated, one can use The Everything to dry a sweaty/wetted head/scalp regardless of how the head/scalp got wetted, or to dry any surfaces that it can latch onto without getting away from the merit/design of the two antler-like halves. The device is configured to prevent hair roots and follicles from getting wet, preserving perms, styles, and hair color.

In an embodiment, an air circulation system is provided for a scalp including a pump and/or means to promote/output air/fluids.

In an embodiment, air/fluid passages/tubes are connected to the pump at one end and connected to a scalp enclosure/cover at an opposite end.

In an embodiment, the scalp enclosure includes apertures for air flow from the pump toward the scalp. The scalp enclosure includes two or more flexible and/or adjustable comb-like structures resembling "deer antlers" halves that contour/conform to a user head.

In an embodiment, at least one fastener secures the two halves of the comb-like structures over a user's head.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entirety are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as examples for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

What is claimed:

1. A multiple channel diffuser system configured to conform to a scalp of a user, comprising:

a multiple channel diffuser, comprising:

a first chamber; and one or more first diffuser channels disposed on the first chamber, wherein the one or more first diffuser channels each having a proximal portion located opposite a distal portion, wherein the proximal portion of the one or more first diffuser channels each having a channel inlet located on the first chamber, the one or more first diffuser channels each having one or more channel outlets;

a second chamber; and one or more second diffuser channels disposed on the second chamber, wherein the one or more second diffuser channels each having a proximal portion located opposite a distal portion, wherein the proximal portion of the one or more second diffuser channels each having a channel inlet located on the second chamber, the one or more second diffuser channels each having one or more channel outlets, wherein the distal portion of the one or more second diffuser channels is removably connected to the distal portion of the one or more first diffuser channels; and a fan;

a power source, the power source is electrically connected to a motor of the fan;

a switch, the switch is electrically connected to the power source;

a hose, the hose having a first end and a second end; and a housing, the housing retaining the power source, the fan, and the switch, wherein the housing having an inlet opening, the first end of the hose is connected to the inlet opening of the housing, the inlet opening of the housing is configured to receive air from the fan and discharge the air into the first chamber of the multiple channel diffuser, the one or more first diffuser channels are configured to discharge the air from the first chamber of the multiple channel diffuser to at least a portion of the scalp of the user, the second chamber of the multiple channel diffuser is in communication with the inlet opening of the housing.

2. The multiple channel diffuser system of claim 1, further comprising:

an outer wall surface of the housing having a clip.

3. The multiple channel diffuser system of claim 1, wherein the one or more channel outlets traverse a length of each of the one or more first diffuser channels.

4. The multiple channel diffuser system of claim 1, further comprising: a three-way fitting, the three-way fitting is connected the hose, wherein the second chamber of the multiple channel diffuser is in communication with at least a portion of the three-way fitting.

5. The multiple channel diffuser system of claim 1, wherein the distal portion of the one or more first diffuser channels has a first fastener, the distal portion of the one or more second diffuser channels has a second fastener, wherein the first fastener of the one or more first diffuser channels is configured to connect to the second fastener of the one or more second diffuser channels.

6. The multiple channel diffuser system of claim 1, further comprising:

a support structure, the support structure extending from an inner wall surface of the housing, the support structure configured to retain the power source.

7. The multiple channel diffuser system of claim 1, wherein the one or more first diffuser channels being made of a flexible material.

8. The multiple channel diffuser system of claim 1, wherein the one or more first diffuser channels are configured to be disposed under at least a portion of a user's hair.

9. The multiple channel diffuser system of claim 1, wherein the first chamber of the multiple channel diffuser has a first end and a second end, the first end of the first chamber of the multiple channel diffuser having a first inlet opening configured to connect to the hose.

10. The multiple channel diffuser system of claim 1, wherein the multiple channel diffuser comprises a left member and a right member, the left member comprising the first chamber and the one or more first diffuser channels, the right member comprising the second chamber and the one or more second diffuser channels.

11. The multiple channel diffuser system of claim 10, wherein a distal portion of the left member comprises a first interlocking feature and a distal portion of the right member comprises a second interlocking feature, the first interlocking feature configured to engage the second interlocking feature.

12. The multiple channel diffuser system of claim 11, wherein the first interlocking feature and the second interlocking feature are configured to maintain the distal portion of the one or more second diffuser channels removably connected to the distal portion of the one or more first diffuser channels.

13. A multiple channel diffuser system configured to conform to a scalp of a user, comprising:

a multiple channel diffuser, comprising:

a first chamber; and a plurality of flexible diffuser channels disposed on the first chamber, wherein the plurality of flexible diffuser channels each having a channel inlet located proximal to the first chamber, the plurality of flexible diffuser channels each having a plurality of channel outlets traversing a length of the plurality of flexible diffuser channels;

a second chamber; and a plurality of second diffuser channels disposed on the second chamber, wherein the plurality of second diffuser channels each having a channel inlet located proximal to the second chamber, the plurality of second diffuser channels each having a plurality of channel outlets traversing a length of the plurality of second diffuser channels, wherein a distal portion of the plurality of second diffuser channels is removably connected to a distal portion of the plurality of flexible diffuser channels; and a fan, the fan is connected to a motor;

a hose, the hose having a first end and a second end;

a housing retaining the fan, the housing having an inlet opening, the first end of the hose is connected to the inlet opening of the housing, the inlet opening of the housing is configured to receive air from the fan and discharge the air into the first chamber of the multiple channel diffuser, the plurality of flexible diffuser channels are configured to discharge the air from the first chamber of the multiple channel diffuser to the scalp of the user, the second chamber of the multiple channel diffuser is in communication with the inlet opening of the housing;

a power source, the power source is electrically connected to the motor of the fan; and a switch, the switch is electrically connected to the power source.

14. The multiple channel diffuser system of claim 13, wherein the plurality of channel outlets of the plurality of flexible diffuser channels are configured to overlay at least a portion of head of the user when the multiple channel diffuser is worn on the head of the user.

15. The multiple channel diffuser system of claim 13, wherein the plurality of channel outlets of the plurality of flexible diffuser channels are configured to overlay at least a portion of the scalp of the user when at least a portion of the multiple channel diffuser is worn under a portion of hair of the user.

16. The multiple channel diffuser system of claim 13, wherein the multiple channel diffuser comprises a left member and a right member, the left member comprising the first chamber and the plurality of flexible diffuser channels, the right member comprising the second chamber and the plurality of second diffuser channels.

17. The multiple channel diffuser system of claim 16, wherein a distal portion of the left member comprises a first interlocking feature and a distal portion of the right member comprises a second interlocking feature, the first interlocking feature configured to engage the second interlocking feature.

18. The multiple channel diffuser system of claim 17, wherein the first interlocking feature and the second interlocking feature are configured to maintain the distal portion of the plurality of second diffuser channels removably connected to the distal portion of the plurality of flexible diffuser channels.

* * * * *